US012484670B2

(12) United States Patent
Pikulski

(10) Patent No.: US 12,484,670 B2
(45) **Date of Patent: *Dec. 2, 2025**

(54) RETRACTABLE UMBRELLA FRAME DEVICE

(71) Applicant: Joseph Pikulski, Westlake Village, CA (US)

(72) Inventor: Joseph Pikulski, Westlake Village, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/538,859

(22) Filed: Dec. 13, 2023

(65) Prior Publication Data

US 2024/0122317 A1 Apr. 18, 2024

Related U.S. Application Data

(63) Continuation of application No. 17/576,693, filed on Jan. 14, 2022, now Pat. No. 11,849,822, which is a (Continued)

(51) Int. Cl.

| | |
|---|---|
| ***A45B 19/00*** | (2006.01) |
| ***A45B 23/00*** | (2006.01) |
| ***A45B 25/02*** | (2006.01) |

(52) U.S. Cl.

CPC ..... *A45B 19/00* (2013.01); *A45B 23/00* (2013.01); *A45B 25/02* (2013.01); *A45B 2019/002* (2013.01); *A45B 2019/007* (2013.01); *A45B 2019/008* (2013.01); *A45B 2023/0006* (2013.01); *A45B 2023/0018* (2013.01)

(58) Field of Classification Search

CPC ..... A45B 2019/002; A45B 2019/008; A45B 2019/007; A45B 2023/0006; A45B 2023/0018

See application file for complete search history.

(56) References Cited

U.S. PATENT DOCUMENTS 3,435,836 A * 4/1969 Vanzini ..... A45B 25/24 135/22
3,534,752 A * 10/1970 Vanzini ..... A45B 19/00 135/22

(Continued)

*Primary Examiner* — David R Dunn
*Assistant Examiner* — Danielle Jackson
(74) *Attorney, Agent, or Firm* — Ferguson Case Orr Paterson

(57) ABSTRACT

Disclosed herein are retractable umbrella frame devices comprising a base body structure at least partially surrounding a central axis structure. The central axis structure can be connected to a skeletal frame structure comprising a plurality of arms having a first end connected to the central axis structure and a second free end. The plurality of arms can be moveably connected to the central axis structure, such that the arms can be retracted into or extended from the base body structure. In some embodiments, the base body structure comprises open portions along its length. In some embodiments, the retractable umbrella frame devices further comprise one or more secondary support structures at least partially surrounding the base body structure. In some embodiments, the retractable umbrella frame devices can further comprise guide structures connected to the one or more secondary support structures and the arms of the skeletal frame structure.

15 Claims, 23 Drawing Sheets

Related U.S. Application Data continuation of application No. 17/146,233, filed on Jan. 11, 2021, now Pat. No. 11,224,269, which is a continuation of application No. 16/131,733, filed on Sep. 14, 2018, now Pat. No. 10,888,144.

(60) Provisional application No. 62/558,743, filed on Sep. 14, 2017.

(56) References Cited

U.S. PATENT DOCUMENTS 3,706,160 A * 12/1972 Deibert ..... A01G 13/0212 47/2
3,709,238 A * 1/1973 Leopoldi ..... A45B 25/24 135/25.41
4,788,996 A * 12/1988 Forshee ..... A45B 25/02 135/25.41
4,821,756 A * 4/1989 England ..... A45B 13/00 135/25.41
5,213,122 A * 5/1993 Grady, II ..... A45B 25/165 135/22
5,690,131 A * 11/1997 Voigt ..... A45B 19/00 135/25.1
6,273,111 B1 * 8/2001 Weiss ..... A45B 25/143 135/25.41
7,581,554 B2 * 9/2009 Glasser ..... A45B 25/14 135/25.41
8,225,806 B1 * 7/2012 Simonelli ..... A45B 25/14 135/34.2
8,485,207 B1 * 7/2013 Boyington ..... E04H 15/06 280/505
9,468,273 B1 * 10/2016 Hasselbach ..... A45B 25/143
9,526,306 B2 * 12/2016 Fitzgerald ..... A45B 19/00
9,822,545 B1 * 11/2017 Kapur ..... A45B 25/143
10,888,144 B2 * 1/2021 Pikulski ..... A45B 23/00
11,224,269 B2 * 1/2022 Pikulski ..... A45B 19/00
11,849,822 B2 * 12/2023 Pikulski ..... A45B 25/02
2009/0056775 A1 * 3/2009 Kuelbs ..... F21V 33/006 135/16
2009/0145469 A1 * 6/2009 Pirlo ..... A45B 25/143 135/23
2009/0293924 A1 * 12/2009 Ham ..... A45B 25/143 135/23
2010/0132751 A1 * 6/2010 Li ..... A45B 23/00 135/96
2013/0167886 A1 * 7/2013 Crain ..... A45B 3/04 135/16
2017/0099919 A1 * 4/2017 Mullet ..... A45B 25/165
2017/0324372 A1 * 11/2017 Gharabegian ..... A45B 25/143
2018/0116351 A1 * 5/2018 Ranieri ..... A45B 19/00

* cited by examiner

RETRACTABLE UMBRELLA FRAME DEVICE

CROSS REFERENCE TO RELATED APPLICATIONS

This application is a continuation of, and claims the benefit of, U.S. utility application Ser. No. 17/576,693 entitled RETRACTABLE UMBRELLA FRAME DEVICE to Joseph L. Pikulski, filed on Jan. 14, 2022, which in turn is a continuation of, and claims the benefit of, U.S. utility application Ser. No. 17/146,233, entitled RETRACTABLE UMBRELLA FRAME DEVICE to Joseph L. Pikulski, filed on Jan. 11, 2021, which in turn is a continuation of, and claims the benefit of, U.S. utility application Ser. No. 16/131,733, entitled RETRACTABLE UMBRELLA FRAME to Joseph L. Pikulski, filed on Sep. 14, 2018, which in turn claims the benefit of U.S. Provisional Application 62/558,743 to Joseph L. Pikulski, also entitled RETRACTABLE UMBRELLA FRAME, filed on Sep. 14, 2017. Each of these applications is hereby incorporated by reference herein in its entirety.

BACKGROUND

Field of the Invention

This present disclosure relates generally to umbrellas and umbrella frames, and more specifically to retractable umbrella frames.

Description of the Related Art

Umbrellas are common devices that are widely used to protect a user from environmental conditions such as rain or sunlight, by covering the user so as to block the path of the environmental condition to the user. Umbrellas typically comprise a tarp portion supported by a skeletal frame structure and a pole that is used to impart functional height to the tarp portion of the umbrella and/or give a user a portion to hold. Some umbrellas are quite bulky and have their pole portions affixed to tables.

Many conventional umbrellas have an "open" configuration, in which the skeletal frame structure is "spread out," enabling the connected tarp structure to effectively cover a desired area. Conversely, these conventional umbrellas also typically have a "closed" configuration, wherein the frame structure is in a collapsed state and the tarp structure is folded in order to conserve space or to more easily transport the umbrella.

One issue with conventional umbrellas, which is especially pertinent to conventional umbrellas affixed to tables, is that the act of transitioning the umbrella between its "open" and "closed" configurations is troublesome. In transitioning a conventional umbrella between its two configurations, the umbrella frame and its associated tarp portion move in a wide arc. This requires more surrounding free-space to allow this movement to effectively occur, requiring the umbrella to be opened or closed in a location spaced-apart from nearby structures or for a connected table to be cleared of objects before attempting to transition a connected umbrella.

Attempts to make umbrellas more compact to mitigate the above issue have utilized enclosed cylindrical structures, which require additional materials, resulting in a bulkier device requiring even more additional components. Additionally, these enclosed cylindrical structures can restrict the movement range of portions of the skeletal frame portion of an umbrella, aggravating device ease of operation.

SUMMARY

Described herein are retractable umbrella frame devices that can be open at various portions along its length (for example, from a first end of the base body structure to a second end of the base body structure). Retractable umbrella frame devices incorporating features of the present invention can further comprise an internal axis structure, which can extend through a center portion of the base body structure, for example, such that the internal axis structure is at least partially surrounded by the base body structure. Retractable umbrella frame devices incorporating features of the present invention can further comprise a skeletal umbrella frame structure, which can comprise a plurality of arms. The arms in the plurality can comprise a free end, and a connected end which can be moveably connected to the internal axis structure.

In one embodiment, a retractable umbrella frame device comprises a base body structure comprising a first end, a second end, and a length between said first end and said second end and further comprises at least one solid support wall between the first end and said second end and at least one opening between the first end and said second end. The retractable umbrella frame device further comprises a central axis structure at least partially surrounded by the base body structure and substantially spanning the length of said base body structure from the first end to the second end. The retractable umbrella frame device further comprises a skeletal frame structure comprising a plurality of arms, with each arm in the plurality comprising a connected end and a free end, with the connected ends moveably connected to said central axis structure such that travel of the connected ends from the second end to the first end retracts the plurality of arms into the base body structure and travel of the connected ends from the first end to the second end extends the plurality of arms from the base body structure.

In another embodiment, a retractable umbrella frame device comprises a base body structure comprising a first end, a second end, and a central axis structure, with the central axis structure substantially spanning the length between the first end and the second end. The retractable umbrella structure further comprises a plurality of secondary support structures connected to the base body structure between the first end and the second end, wherein at least two support structures in the plurality of support structures are spaced apart from one another, and comprises a skeletal umbrella structure comprising a plurality of arms, each arm in the plurality of arms comprising a connected end and a free end, with the connected ends moveably connected to the central axis structure such that travel of the connected ends from the second end to the first end retracts the plurality of arms into the base body structure and travel of the connected ends from the first end to the second end extends the plurality of arms from said base body structure.

In yet another embodiment, a retractable umbrella frame device comprises a base body structure, said base body structure comprising a first end, a second end, and a length between the first end and said second end, with the base body structure comprising at least one solid support wall between the first end and the second end and at least one opening between the first end and the second end. The retractable umbrella frame device further comprises a central axis structure, with the central axis structure at least partially surrounded by the base body structure and substantially spanning the length of the base body structure from the first end to the second end. The retractable umbrella frame device further comprises a plurality of secondary support structures connected to the base body structure between the first end and the second end, wherein at least two support structures in the plurality of support structures are spaced apart from one another. The retractable umbrella frame device further comprises a skeletal frame structure, the skeletal frame structure comprising a plurality of arms, each arm in the plurality of arms comprising a connected end and a free end, the connected ends moveably connected to the central axis structure such that travel of the connected ends from the second end to the first end retracts the plurality of arms into the base body structure and travel of the connected ends from the first end to the second end extends the plurality of arms from the base body structure. The retractable umbrella frame device further comprises one or more guide structures connected to at least one of the arms in the plurality of arms and at least one of the secondary support structures in the plurality of secondary support structures.

These and other further features and advantages of the invention would be apparent to those skilled in the art from the following detailed description, taken together with the accompanying drawings, wherein like numerals designate corresponding parts in the figures, in which:

DETAILED DESCRIPTION

Figure 1A:
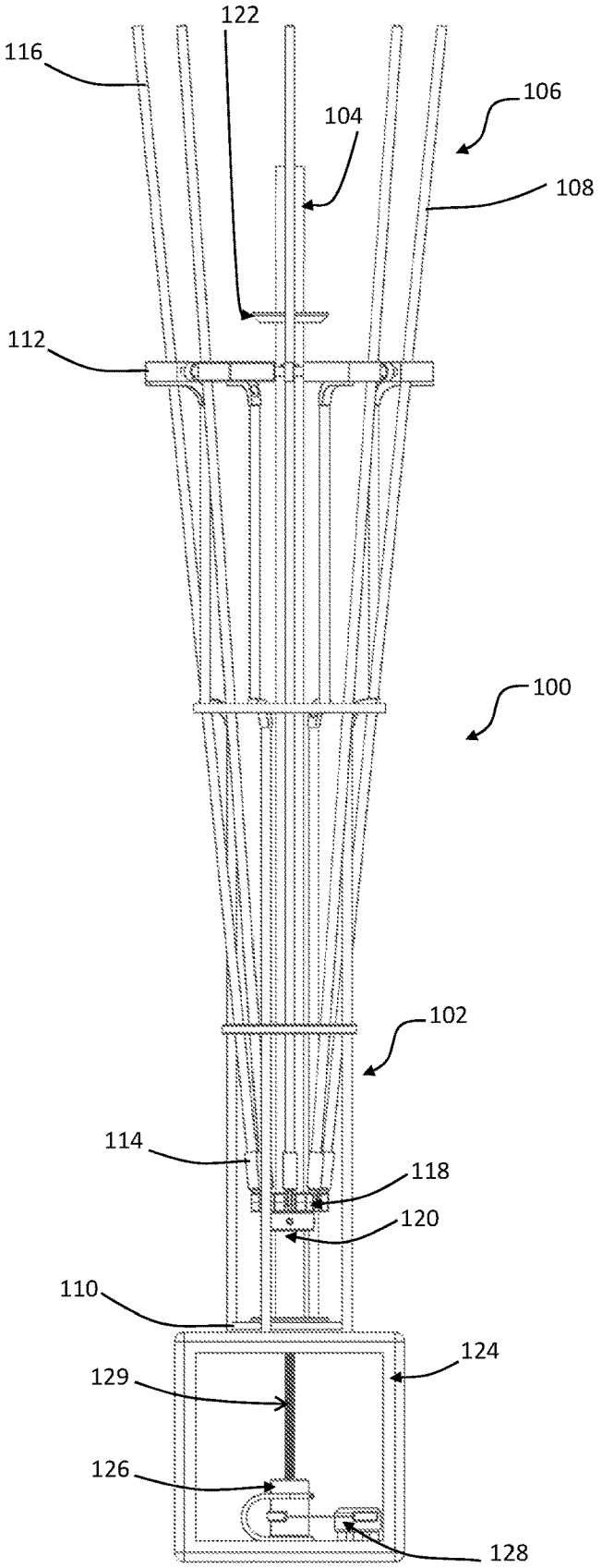
FIG. 1A is a front view of a first embodiment of a retractable umbrella frame device incorporating features of the present invention.

In the following detailed description, numerous specific details are set forth in order to provide a more thorough understanding of embodiments incorporating features of the present invention. However, it will be apparent to one skilled in the art that the present invention can be practiced without necessarily being limited to these specifically recited details. Described herein are retractable umbrella frame devices that can be utilized with a corresponding tarp structure to form a working umbrella unit.

Retractable umbrella frame devices incorporating the features of the present invention can comprise a base body structure that can be open at various portions along its length (for example, from a first end of the base body structure to a second end of the base body structure). Retractable umbrella frame devices incorporating features of the present invention can further comprise an internal axis structure, which can extend through a center portion of the base body structure, for example, such that the internal axis structure is at least partially surrounded by the base body structure. The internal axis structure can run partially, substantially or entirely the length of the base body structure.

Retractable umbrella frame devices incorporating features of the present invention can further comprise a skeletal umbrella frame structure, which can comprise a plurality of arms. The arms in the plurality can comprise a free end, and a connected end which can be moveably connected to the internal axis structure, either directly connected or via an intermediate structure such as a hub, such that movement of the arms along the internal axis structure causes the arms to retract into or extend from the base body structure.

In some embodiments, the retractable umbrella frame devices incorporating features of the present invention can comprise further organizational structures that can facilitate movement of the arms and/or organize or otherwise position the arms in order to further ensure proper device functionality. In some embodiments, these organizational structures can include rings connected to the base body structure. In some embodiments, these organizational structures can further comprise guide structures connected to the rings, which are in turn connected to the base body structure. In some embodiments, these organizational structures can comprise channels at least partially spanning the length of the base body structure from a first end to a second end.

All the features disclosed in this specification, (including any accompanying claims, abstract, and drawings) may be replaced by alternative features serving the same, equivalent or similar purpose, unless expressly stated otherwise. Thus, unless expressly stated otherwise, each feature disclosed is one example only of a generic series of equivalent or similar features.

Throughout this description, the preferred embodiment and examples illustrated should be considered as exemplars, rather than as limitations on the present invention. As used herein, the term "invention," "device," "present invention," or "present device" refers to any one of the embodiments of the invention described herein, and any equivalents. Furthermore, reference to various feature(s) of the "invention," "device," "present invention," or "present device" throughout this document does not mean that all claimed embodiments or methods must include the referenced feature(s).

Furthermore, any element in a claim that does not explicitly state "means for" performing a specified function, or "step for" performing a specific function, is not to be interpreted as a "means" or "step" clause as specified in 35 U.S.C. § 112, for example, in 35 U.S.C. § 112(f) or pre-AIA 35 U.S.C. § 112, sixth paragraph.

It is also understood that when an element or feature is referred to as being "on" or "adjacent" to another element or feature, it can be directly on or adjacent the other element or feature or intervening elements or features may also be present. It is also understood that when an element is referred to as being "attached," "connected" or "coupled" to another element, it can be directly attached, connected or coupled to the other element or intervening elements may be present. In contrast, when an element is referred to as being "directly attached," "directly connected" or "directly coupled" to another element, there are no intervening elements present. For example, if an upper support component is said to be connected to a lower support component, which in turn is said to be connected to a base component, it is also correct to say that the upper support component is connected to the base component (through the intervening connection of the lower support component). Furthermore, the upper support component in the previous example would not be "directly" connected to the base component, but would be "directly" connected to the lower support component.

Please note, if used, relative terms such as "left," "right," "front," "back," "top," "bottom," "forward," "reverse," "clockwise," "counter clockwise" "outer," "above," "upper," "lower," "below," "horizontal," "vertical" and similar terms, have been used for convenience purposes only and are not intended to imply any particular fixed direction. Instead, they are used to reflect relative locations and/or directions between various portions of an object.

Although the terms first, second, etc. may be used herein to describe various elements or components, these elements or components should not be limited by these terms. These terms are only used to distinguish one element or component from another element or component. Thus, a first element or component discussed below could be termed a second element or component without departing from the teachings of the present invention.

The terminology used herein is for describing particular embodiments only and is not intended to be limiting of the invention. As used herein, the singular forms "a," "an," and "the" are intended to include the plural forms as well, unless the context clearly indicates otherwise. It will be further understood that the terms "comprises," "comprising," when used herein, specify the presence of stated features, integers, steps, operations, elements, and/or components, but do not preclude the presence or addition of one or more other features, integers, steps, operations, elements, components, and/or groups thereof.

Embodiments of the invention are described herein with reference to different views and illustrations that are schematic illustrations of idealized embodiments of the invention. As such, variations from the shapes of the illustrations as a result, for example, of manufacturing techniques and/or tolerances are expected. Embodiments of the invention should not be construed as limited to the particular shapes of the regions illustrated herein, but are to include deviations in shapes that result, for example, from manufacturing.

It is understood that when a first element is referred to as being "between," "sandwiched," or "sandwiched between" two or more other elements, the first element can be directly between the two or more other elements or intervening elements may also be present between the two or more other elements. For example, if a first element is "between" or "sandwiched between" a second and third element, the first element can be directly between the second and third elements with no intervening elements or the first element can be adjacent to one or more additional elements with the first element and these additional elements all between the second and third elements.

FIGS. 1A-1E of the present application show a mode of operation of an embodiment of a retractable umbrella frame device incorporating features of the present invention. In the mode of operation shown beginning with FIG. 1A and progressing through FIG. 1E, the retractable umbrella frame device is shown transitioning from its retracted state, where an associated umbrella is collapsed or otherwise "closed" or folded up, to the extended skeletal frame state, where an associated umbrella is "open" or otherwise extended and spread out.

FIG. 1A shows a retractable umbrella frame device 100, comprising a base body structure 102, an internal axis structure 104 and a skeletal umbrella frame structure 106. The retractable umbrella frame device 100, including the base body structure 102, the internal axis structure 104 and the skeletal umbrella frame structure 106 can comprise any suitable material that imparts sufficient structure to perform the function of being a retractable umbrella frame as set forth herein. Some suitable materials the umbrella frame device 100 can comprise include, but are not limited to, resin, rubber, vinyl, polyurethane, poly vinyl chloride (PVC), Poly(methyl methacrylate) (PMMA), polystyrene foam, polymers/copolymer substances, acrylic substances, plastic, metal, glass, fiberglass, wood or a combination thereof.

FIG. 1A shows the retractable umbrella frame device 100 in its fully retraced (i.e. "closed") state, where arms 108 of the skeletal umbrella frame structure 106 are substantially withdrawn into the base body structure 102. As shown in FIG. 1A, the internal axis structure 104 is at least partially within the confines of, or otherwise surrounded by, the base body structure 102, and in the embodiment shown, the internal axis structure 104 spans the length of the base body structure 102, from a first end 110 of the base body structure 102 to a second end 112 of the base body structure 102, and even extends beyond this distance. However, in some embodiments, the internal axis structure 104 spans a lesser distance than substantially the entire distance from the first end 110 to the second end 112. In some preferred embodiments, the internal axis structure 104 substantially spans the distance from the first end 110 to the second end 112, as in FIG. 1A.

As shown in FIG. 1A, the internal axis structure 104 can be positioned substantially in the center of the internal portion of the base body structure 102, although it is not necessary for internal axis structure 104 to be centralized, or even substantially centralized, and in some embodiments, the internal axis structure 104 is off-center. The internal axis structure 104 is configured to function as a "track-like" structure, that is, a stationary, or semi-stationary, structure that allows the arms 108 of the skeletal umbrella frame structure 106 to move about it, for example, moving vertically along the length of the internal axis structure 104, for example, from the first end 110 of the base body structure 102 to the second end 112 (or from the second end 112 to the first end 110).

The arms 108 of the skeletal umbrella frame structure 106 can comprise two ends, for example, a connected end 114, that can be moveably connected to internal axis structure 104 and a free end 116 opposite the connected end 114. The arms 108 can be directly connected to the internal axis structure 104, or can be connected to the internal axis structure 104 through one or more intermediate elements, for example, a hub structure 118 as shown in FIG. 1A.

In embodiments wherein the internal axis structure 104 spans substantially the length of the base body structure 102 from the first end 110 to the second end 112, the connected ends 114 of the arms 108 can move this distance along the internal axis 104, such that movement of the connected ends 114 of the arms toward the first end 110 of the base body structure 102 draws the arms into the base body structure 102, retracting the skeletal umbrella frame structure 106. Conversely, in these embodiments, movement of the connected ends 114 of the arms 108 toward the second end 112 of the base body structure 102 extends the arms 108 from the base body structure 102, extending and opening the skeletal umbrella frame structure 106.

Also shown in FIG. 1A are additional structures that can be optionally included in the retractable umbrella frame device 100, including a first stop structure 120 and a second stop structure 122. These stop structures 120, 122 are connected to, or are otherwise portions of, the internal axis structure 104 and function to define travel distance limits of the connected ends 114 of the arms 108. For example, in the embodiment shown in FIG. 1A, the first stop structure 120 is a portion of the internal axis structure 104 near the first end 110 of the base body structure 102, as will be discussed in more detail with regard to FIG. 1K herein. This configuration prevents the connected ends 114 of the arms 108 from traveling any lower on the internal axis structure 104 (i.e. any nearer to or beyond the first end 110 of the base body structure 102.

In embodiments wherein the connected ends 114 of the arms 108 are connected to the internal axis structure 104 via a hub structure 118 that at least partially surrounds and travels along the internal axis structure 104, such as in the embodiment shown in FIG. 1A, the hub structure 118 can abut against the first stop portion 120, preventing further movement in the direction toward the first end 110 of the base body structure 102. In other embodiments, the first stop structure 120 can comprise a portion of the internal axis structure 104 itself that has a wider diameter that the rest of the internal axis structure 104. The hub structure 118 is described in more detail further herein in regard to FIG. 1K.

The second stop structure 122 can have a similar structure to the first stop structure 120 and can function similarly, except that the second stop structure 122 is located on a portion of the internal axis structure 104 near the second end 112 of the base body structure 102. This configuration prevents the connected ends 114 of the arms 108 from traveling any higher on the internal axis structure 104 (i.e. any nearer to or beyond) the second end 112 of the base body structure 102. Another difference between the specific second stop structure 122 shown in FIG. 1A and the first stop structure 120 is that the second stop structure 122 comprises a disk-like shape which extends beyond the diameter of the majority of the internal axis structure 104, although it is understood that other configurations can be utilized.

Similarly to the function of the first stop structure 120, in embodiments wherein the connected ends 114 of the arms 108 are connected to the internal axis structure 104 via the hub structure 118 that at least partially surrounds and travels along the internal axis structure 104, the hub structure 118 can abut against the second stop portion 122, preventing further movement in the direction toward the second end 112 of the base body structure 102.

The stop structures 120, 122 can comprise any shape, material or orientation suitable for preventing movement of the connected ends 114 of the arms 108 (or an associated intermediate connection structure such as a hub structure 118) from moving past a given point. However, it is understood that in some embodiments the stop structures 120, 122 are not utilized. Furthermore, range of travel of the connected ends 114 of the arms 108 can also be controlled in other ways than utilizing stop structures 120, 122, for example, the length of internal axis structure 104 can be altered to a desired length or portions of the internal axis structure 104 can be magnetized to hold the connected ends 114 of the arms 108 in place when they reach a certain distance point on the internal axis structure 104.

Another optional structure shown in the embodiment of FIG. 1A is the mounting base 124, which can comprise any of the material configurations discussed herein with regard to portions of the retractable umbrella frame device 100. Aside from providing an additional mounting surface for the retractable umbrella frame device 100, for example, so the base body structure 102 does not have to be mounted to a surface, the mounting base 124 can be utilized as an area to store additional operational features, for example, an actuation mechanism 126 (shown schematically), that can be in communication with the internal axis structure 104 and/or the connected ends 114 of the arms 108 and/or an intermediate connection structure such as the hub structure 118. In some embodiments, the mounting base can comprise power features, for example, a power source such as a battery or any known power source.

The mounting base 124 can further comprise electronic control features 128 (shown schematically), for example, control circuits, printed circuit boards (PCBs), or a central processing unit and memory. The mounting base 124 provides a structure to contain these additional optional features (i.e. an actuation mechanism and/or electronic control features 128), so that these additional features would not have to be housed in another portion of the retractable umbrella frame device 100, for example, the internal axis structure 104 or the base body structure 102.

The mounting base 124 and/or the internal axis structure 104 can further comprise a moveable component 129, which can be connected to the hub structure 118 and/or the arms 108 of the skeletal umbrella frame structure 106 and can be configured to more or otherwise change position to allow for movement of the arms 108 or and/or the hub structure 118. The moveable component 129 is discussed in more detail herein with regard to FIG. 1B and FIG. 1K.

It is understood that while the mounting base 124 is shown herein as transparent, with its internal components visible (including the actuation mechanism 126, the electronic control features 128, and the moveable component 129), the mounting base 124 is shown this way for convenience and illustrative purposes and the mounting base 124 can be solid, with the internal components not visible.

Figure 1B:
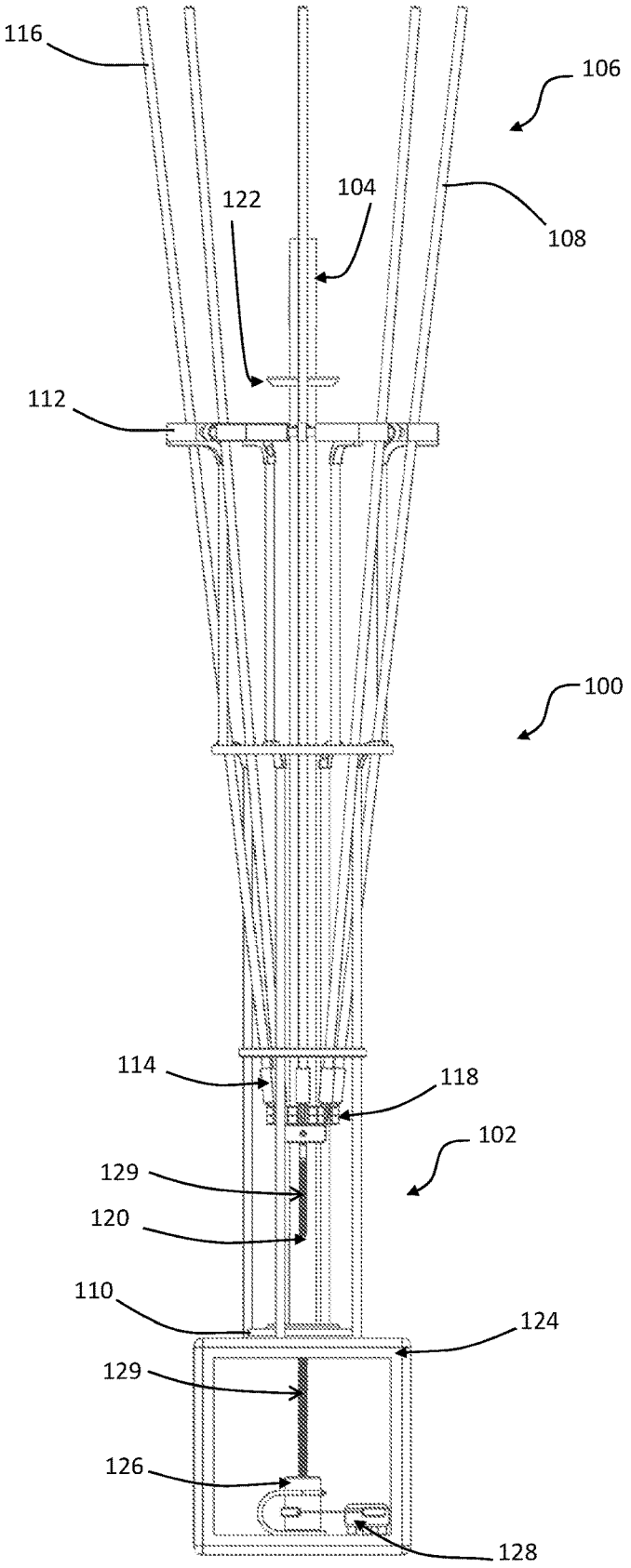
FIG. 1B is a front view of the embodiment of the retractable umbrella frame device of FIG. 1A, shown in a different orientation.

FIG. 1B shows the retractable umbrella frame device 100 of FIG. 1A, progressing further through the process of extending the skeletal umbrella frame structure 106 from the base body structure 102, transitioning the retractable umbrella frame device 100 from its retracted or "closed" state to its extended or "open" state. As shown in FIG. 1B, the retractable umbrella frame device 100 comprises the same features as shown in FIG. 1A, including: the base body structure 102 (spanning a length from the first end 110 to the second end 112), the internal axis structure 104, the skeletal umbrella frame structure 106, the arms 108 (comprising connected ends 114 and free ends 116), the hub structure 118, the first stop structure 120, the second stop structure 122, the mounting base 124 (which comprises the actuation mechanism 126 and the electronic control features 128), and the moveable component 129.

As is shown in FIG. 1B, the connected ends 114 of the arms 108, that are connected to the internal axis structure 104 via the hub structure 118, are moving along the internal axis structure 104 farther from the first end 110 of the base body structure 102 and closer toward to the second end 112 of the base body structure 102. This results in arms 108, beginning with their free ends 116, extending from the second end 112 of the base body structure 102. The exact system of imparting the motion to the connected ends 114 of the arms 108 such that the connected ends 114 move about the length of the internal axis structure 104 will vary from embodiment to embodiment, although any known structure or configuration can be utilized. In the embodiment shown, an actuation mechanism 126 is utilized, for example, a motor, such as a threaded screw motor, similar to what is utilized in garage door openers. In these embodiments, a threaded lead screw can function as the moveable component 129 in conjunction with the motor functioning as the actuation mechanism 126, with the arms 108 and/or the hub 118 connected to the threaded lead screw 129 and the length of the threaded lead screw running the length of the internal axis structure 104 such that movement of the lead screw 129 causes movement of the hub 118 and/or the arms 108. This specific embodiment will be discussed in further detail with regard to FIG. 1K herein. In some embodiments, the actuation mechanism can comprise a solenoid or any known motor structures, including an electric or gas motor.

While the embodiment shown comprises an actuation mechanism 126, it is understood that other configurations to impart movement can be utilized, for example, the connected ends 114 of the arms can be manually operated to move along the length of the internal axis structure 104, for example, by accessing the connected ends 114 and/or an intermediate connection structure through openings in the base body structure 102, for example, accessing the hub structure 118 and physically moving the connected ends 114 or the hub structure 118 to a desired position along the length of the internal axis structure 104. In some embodiments, the actuation mechanism 126 does not comprise a motor, but instead comprises a manual mechanism, for example, a hand crank configured with an track or threaded screw internal to the internal axis structure 104, such that operation of the hand crank moves the track or threaded screw, which in turn moves the connected ends 114 and/or the hub structure 118, which can be connected to the internal screw mechanism.

Figure 1C:
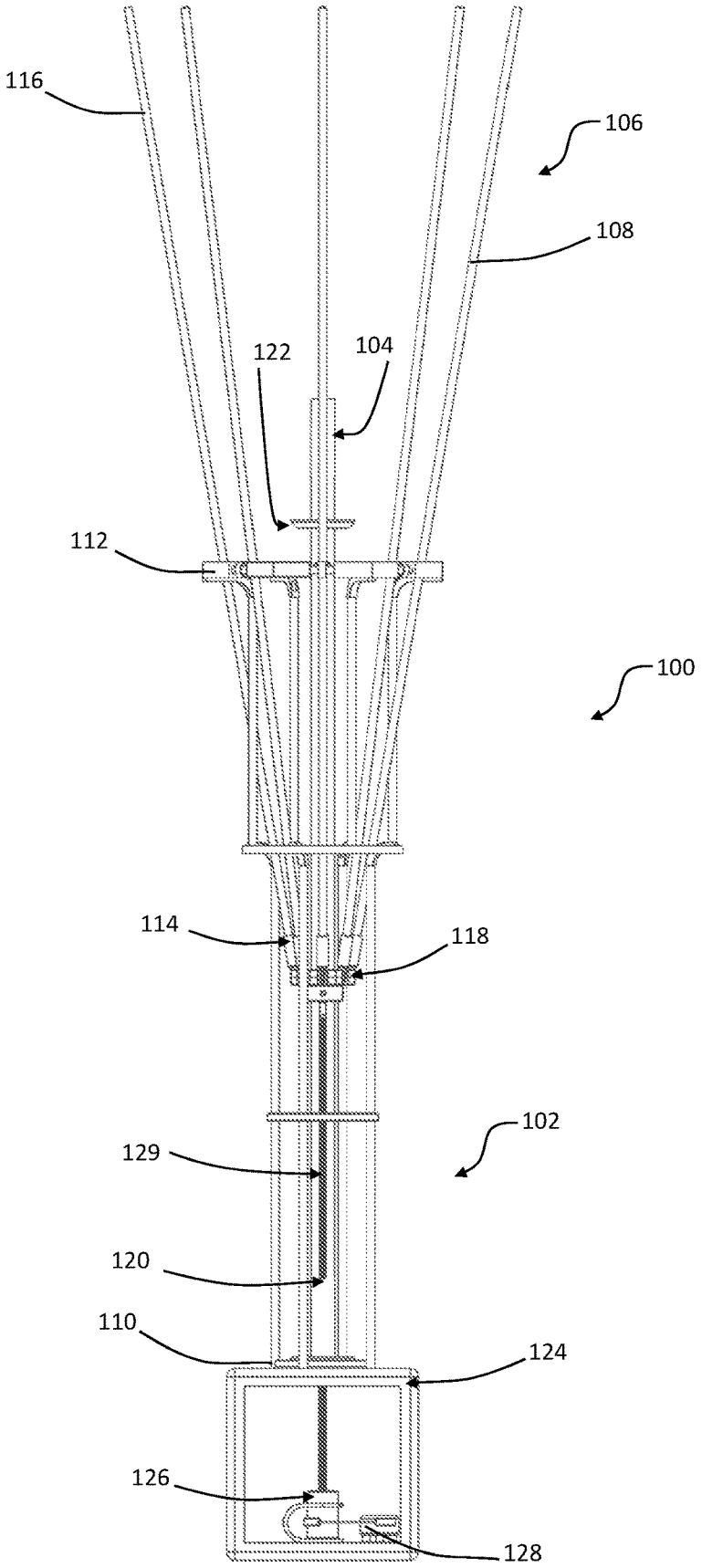
FIG. 1C is a front view of the embodiment of the retractable umbrella frame device of FIG. 1B, shown in a different orientation.

FIG. 1C shows the retractable umbrella frame device 100 of FIG. 1A, progressing even further through the process of extending the skeletal umbrella frame structure 106 from the base body structure 102 than in FIG. 1B, transitioning the retractable umbrella frame device 100 even further from its retracted or "closed" state to its extended or "open" state. As shown in FIG. 1C, the retractable umbrella frame device 100 comprises the same features as shown in FIG. 1A, including: the base body structure 102 (spanning a length from the first end 110 to the second end 112), the internal axis structure 104, the skeletal umbrella frame structure 106, the arms 108 (comprising connected ends 114 and free ends 116), the hub structure 118, the first stop structure 120, the second stop structure 122, the mounting base 124 (which comprises the actuation mechanism 126 and the electronic control features 128), and the moveable component 129.

Figure 1D:
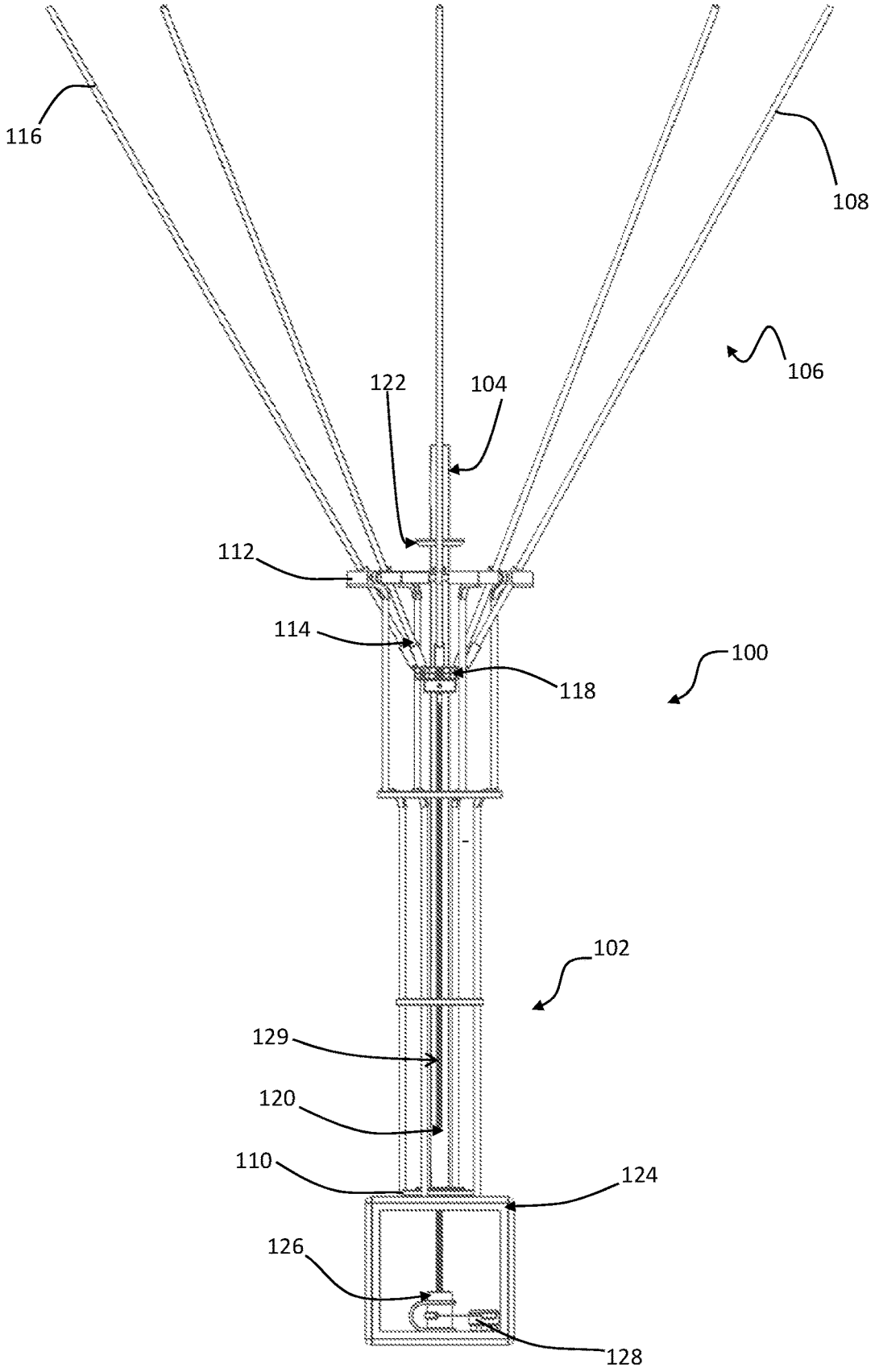
FIG. 1D is a front view of the embodiment of the retractable umbrella frame device of FIG. 1C, shown in a different orientation.

FIG. 1D shows the retractable umbrella frame device 100 of FIG. 1A, progressing even further through the process of extending the skeletal umbrella frame structure 106 from the base body structure 102 than in FIG. 1C, transitioning the retractable umbrella frame device 100 even further from its retracted or "closed" state to its extended or "open" state. As shown in FIG. 1D, the retractable umbrella frame device 100 comprises the same features as shown in FIG. 1A, including: the base body structure 102 (spanning a length from the first end 110 to the second end 112), the internal axis structure 104, the skeletal umbrella frame structure 106, the arms 108 (comprising connected ends 114 and free ends 116), the hub structure 118, the first stop structure 120, the second stop structure 122, the mounting base 124 (which comprises the actuation mechanism 126 and the electronic control features 128), and the moveable component 129.

Figure 1E:
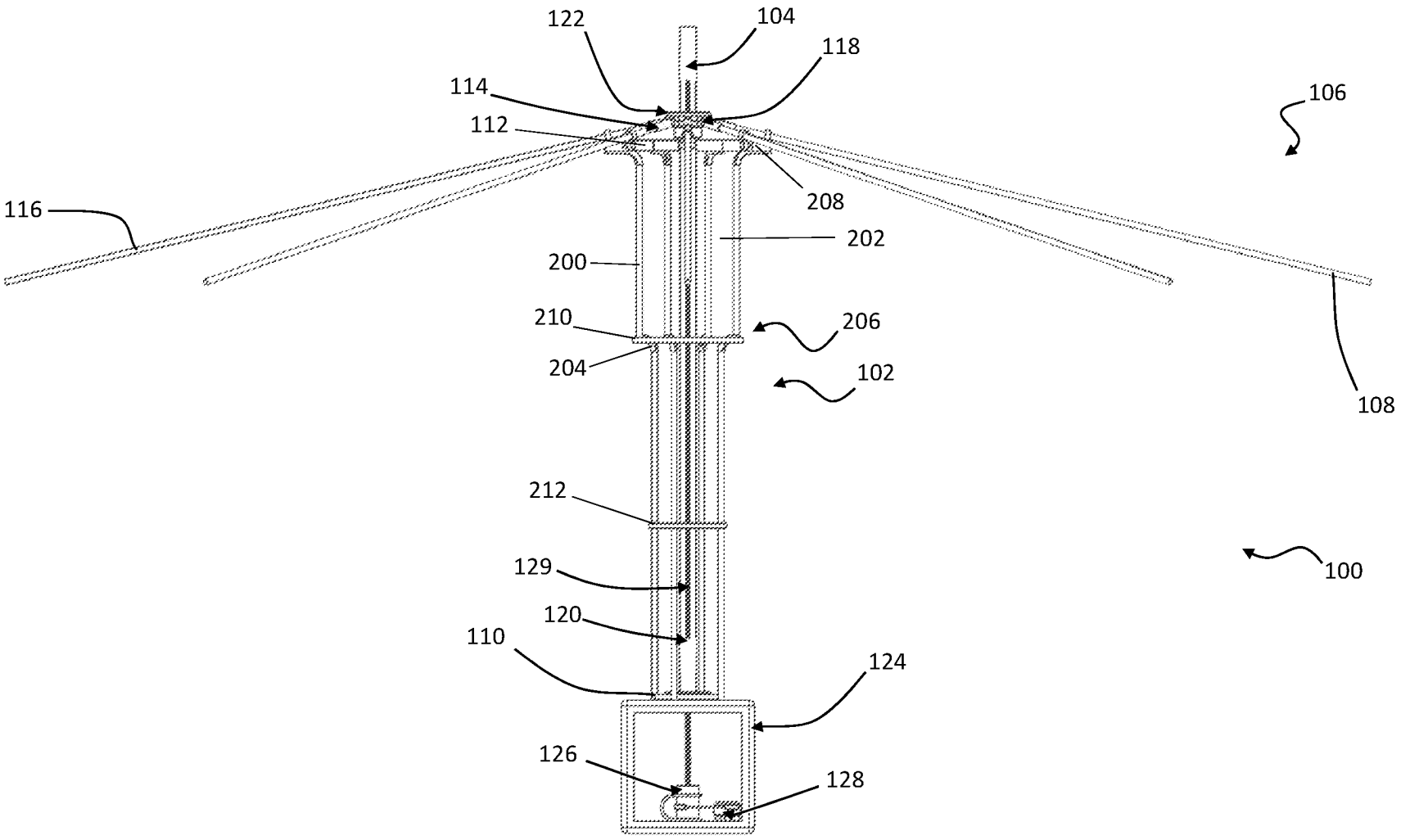
FIG. 1E is a front view of the embodiment of the retractable umbrella frame device of FIG. 1D, shown in a different orientation.

FIG. 1D further shows that the transition from a "closed" configuration to an "open" configuration has progressed to the point where the angle of connection between the connected ends 114 of the arms 108 to the internal axis structure 104 can begin to change to allow the free ends 116 of the arms 108 to begin moving from pointing upwards, allowing retraction of the skeletal umbrella frame structure 106 into the base body structure 102, to pointing downwards (as shown in FIG. 1E), allowing for the skeletal umbrella frame structure 106 to function as an umbrella frame and cover an area with a connected tarp portion.

Accordingly, the connected ends 114 of the arms 108 can be moveably connected to the internal axis structure 104 in at least two ways: first, the connected ends 114 can be connected such that the connected ends 114 move along the length of the internal axis structure 104, for example, from a position near the first end 110 of the base body structure 102 to a position near the second end 112 of the base body structure 102; and second, the connected ends 114 can be moveably connected to the internal axis structure 104 such that the angle of connection from the connected ends 114 to the internal axis structure 104 can change. Various example connection configurations allowing for this change in angle of connection are discussed in further detail with regard to FIG. 1K herein.

FIG. 1E shows the retractable umbrella frame device 100 of FIG. 1A, progressing to its fully extended or "open state," wherein the skeletal umbrella frame structure 106 is fully extended from the base body structure 102 and is spread out so as to serve as an umbrella frame and cover a designated area. As shown in FIG. 1E, the retractable umbrella frame device 100 comprises the same features as shown in FIG. 1A, including: the base body structure 102 (spanning a length from the first end 110 to the second end 112), the internal axis structure 104, the skeletal umbrella frame structure 106, the arms 108 (comprising connected ends 114 and free ends 116), the hub structure 118, the first stop structure 120, the second stop structure 122, the mounting base 124 (which comprises the actuation mechanism 126 and the electronic control features 128), and the moveable component 129.

As the skeletal umbrella frame structure 106 is shown fully extended in FIG. 1E, the base body structure 102 is more easily visualized and is described in greater detail with reference to FIG. 1E herein. As shown in FIG. 1E, the base body structure 102 can comprise one or more solid base body support walls 200, which are solid portions of the base body structure 102 and which, as is shown in the embodiment of FIG. 1E, can span the length of the base body structure 102, for example, from the first end 110 to the second end 112. The base body structure 102 can further comprise one or more open portions 202 of the base body structure, which can span the entire length of the base body structure 102 from the first end 110 to the second end 112, can span substantially the entire length of the base body portion 102, or can span only a partial portion of the length. In some embodiments, the open portions 202 can separate adjacent solid base body support walls 200 from one another as is shown in FIG. 1E.

At least some advantages of the base body structure 102 of the retractable umbrella frame device 100 comprising open portions 202 include that the retractable umbrella frame device 100 can be much lighter and less bulky than if the retractable umbrella frame device 100 comprises a completely solid base body structure 102, for example, because less material is utilized. Furthermore, the open portions 202 provide easy user access to the internal portions of the retractable umbrella frame device 100, allowing for a user to manually access portions of the arms 108, the hub 118, or a connected umbrella tarp. This allows a user to make small manual adjustments to the retractable umbrella frame device 100, for example, correcting or fixing a minor snag or stuck connected umbrella tarp or a stuck arm to correct a potential device malfunction in a simple manner without dissembling the entire device.

The base body structure 102 can be "tapered" and/or the solid base body support walls 200 can be staggered or otherwise configured such that the initial diameter of the base body structure 102 near the second end of the base body structure 102 is wider than the diameter of a portion of the base body structure 102 nearer to the first end 110 of the base body structure 102. By having the diameter nearest to the first end 110, which corresponds to the end in which movement of the hub 118 toward the first end 110 constitutes retraction of the arms 108 into the base body structure 102, the arms 108 are more free to move and change angles near the top of the base body structure 102 near the second end 112 and are less free to move and are therefore more secured and organized when nearly fully retracted.

Likewise, when the arms 108 are being extended from the base body structure 102, premature movement of the arms 108 and the angle change of the arms 108 in relation to the hub 118 is discouraged by the less physical room available due to the reduced diameter of the portion of the base body structure 102 nearer the first end 110 of the base body structure 102. As extension of the arms 108 form the base body structure 102 proceeds, the hub 118 moves the connected ends 114 of the arms 108 toward the second end 112 of the base body structure 102. As the diameter is wider in this region, the arms 108 can more fully move and change angular position in relation to the hub 118, facilitating full extension of the arms.

Figure 3A:
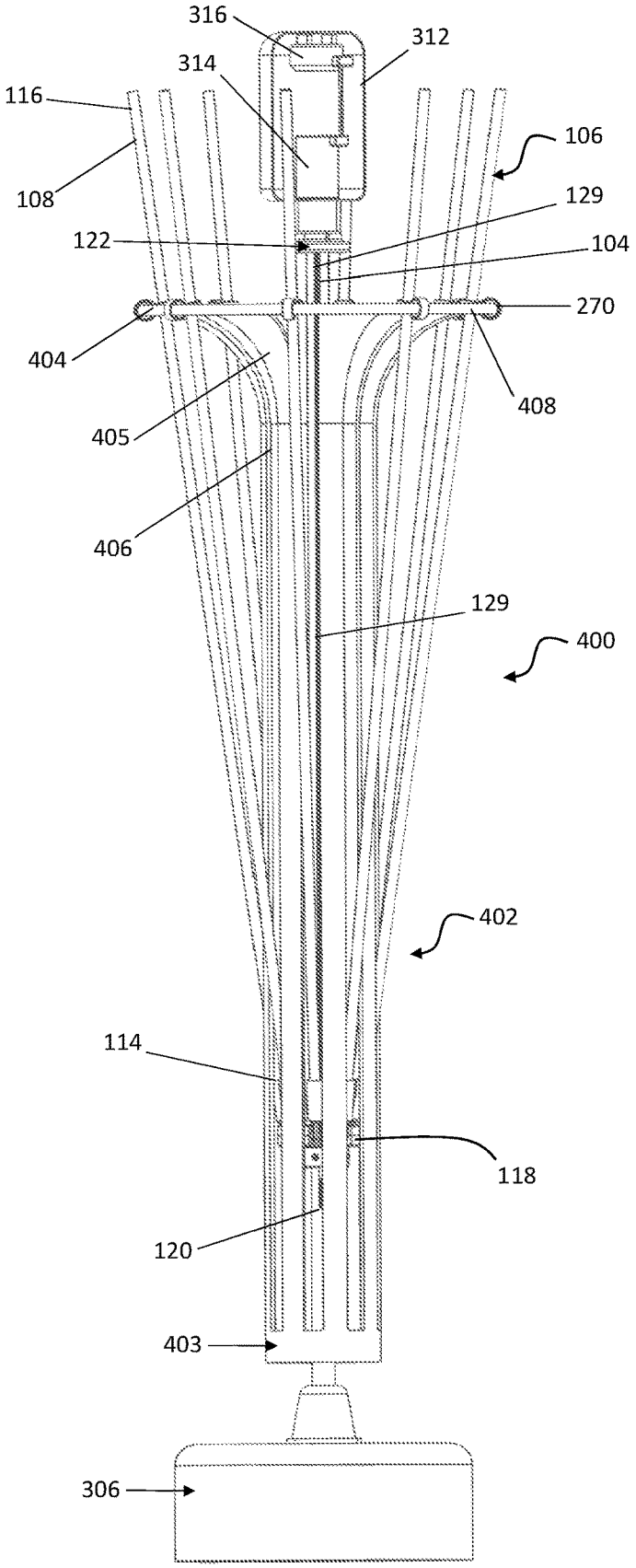
FIG. 3A is a front view of a third embodiment of a retractable umbrella frame device incorporating features of the present invention.
Figure 3B:
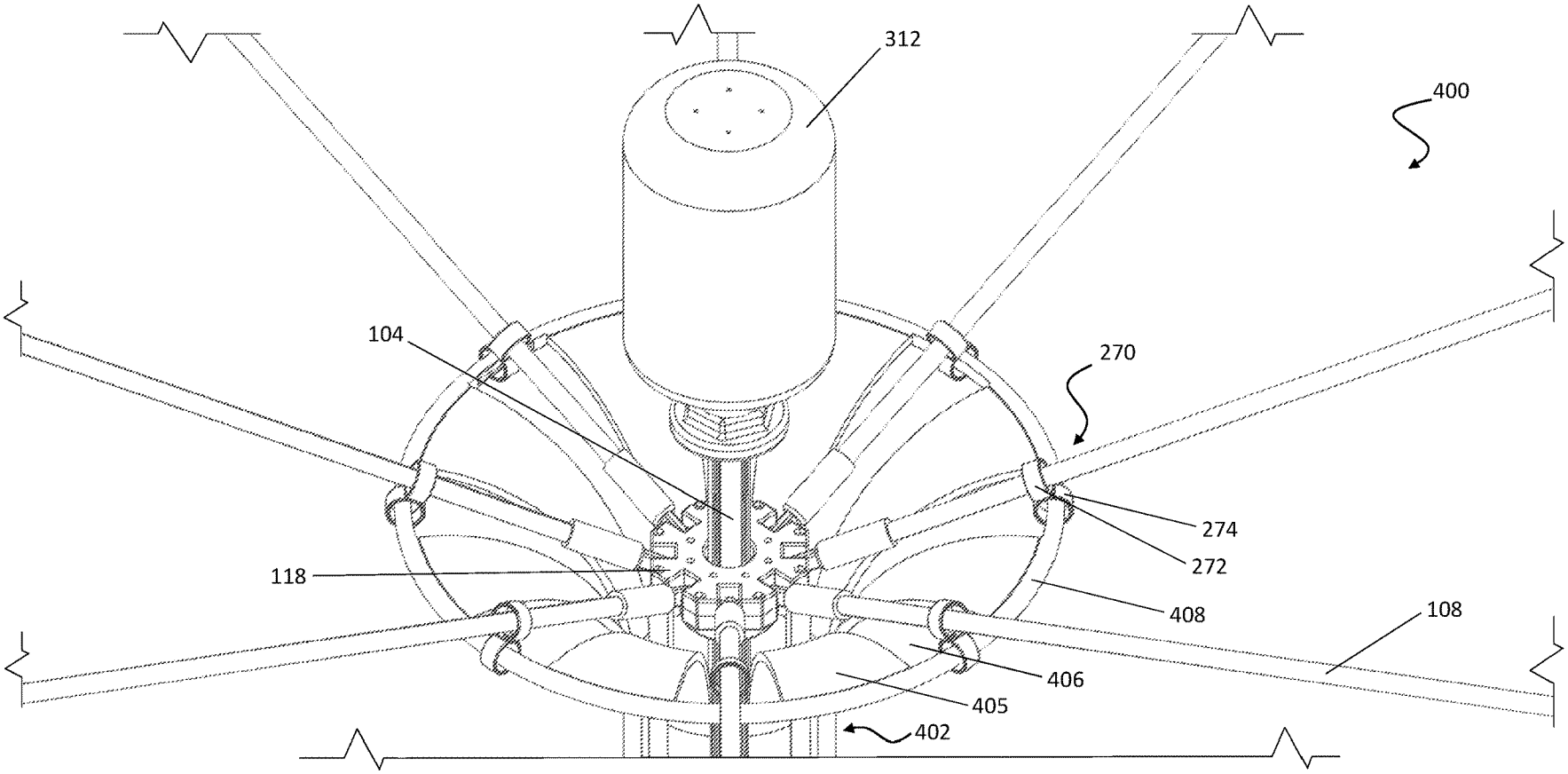
FIG. 3B is a partial front top perspective view of the retractable umbrella frame device of FIG. 3A, showing additional features.

It is understood that while the present disclosure refers to the optional tapering of the base body structure 102 as a widening or narrowing of the "diameter," this is not meant to imply that the base body structure 102 must be circular or spherical in nature, and encompasses a widening or narrowing of the base body structure 102 along its length from the first end 110 to the second end 112 regardless of its shape. This tapering can be nearly seamless and gradual, for example, forming curved structures as are best seen in FIGS. 3A and 3B. In some embodiments, such as the embodiment shown in FIG. 1E, the tapering can be more defined by one or more specific tapering points 204, where the diameter decreases.

The base body structure 102 can further comprise one or more secondary support structures 206, for example, as shown in FIG. 1E, one or more ringed structures substantially surrounding one or more portions of the solid base body support walls 200 of the base body structure 102. In the embodiment shown in FIG. 1E, the secondary support structures 206 comprise a first ring 208, a second ring 210 and a third ring 212. The secondary support structures 206 provide additional stability for the base body structure 102. In some embodiments, the secondary support structures 206 can help define tapering points 204. For example, in some embodiments, such as the embodiment shown in FIG. 1E, a first set of solid base body support walls 200 can be connected between the first ring 208 and the second ring 210, defining a first diameter for that portion of the retractable umbrella frame device 100 between the first ring 208 and the second ring 210. A second set of solid base body support walls 200, positioned closer together, can be connected to the second ring 210 and the third ring 212, defining a second and smaller diameter for that portion of the retractable umbrella frame device 100 between the second ring 210 and the third ring 212, therefore producing a tapering effect.

Another advantage of utilizing the secondary support structures 206 is that the secondary support structures 206 can provide a continuous outer border for portions of the base body structure 102 in embodiments wherein open portions 202 of the base body structure 102 are continuous along a significant portion of the length of the base body structure 102. For example, in the embodiment shown in FIG. 1E, the open portions 202 of the base body structure 102 span the entire length of the base body structure 102 from the first end 110 to the second end 112. This results in "breaks" in between solid base body support walls 200 which can potentially result in portions of the arms 108 exiting the base body structure 102 at undesirable intervals. In order to maintain the advantages of the open portions 202 of the base body structure 102, while still providing solid support across the length of the base body structure 102, the secondary support structures 206 can be utilized to enclose small continuous horizontal portions around the base body structure 102 to prevent portions of the arms 108 from exiting the base body structure 102 by providing a continuous horizontal surface for an arm 108 to abut against to block its path.

It is understood that while the secondary support structures 206 are shown and described in FIG. 1E as being "rings" any other shape, including any regular or irregular polygon, or structural arrangement configured to provide the support as described herein is within the scope of the present disclosure. It is further understood that the secondary support structures can comprise additional features, for example, additional guide structures and/or lighting features as described further herein.

Figure 1F:
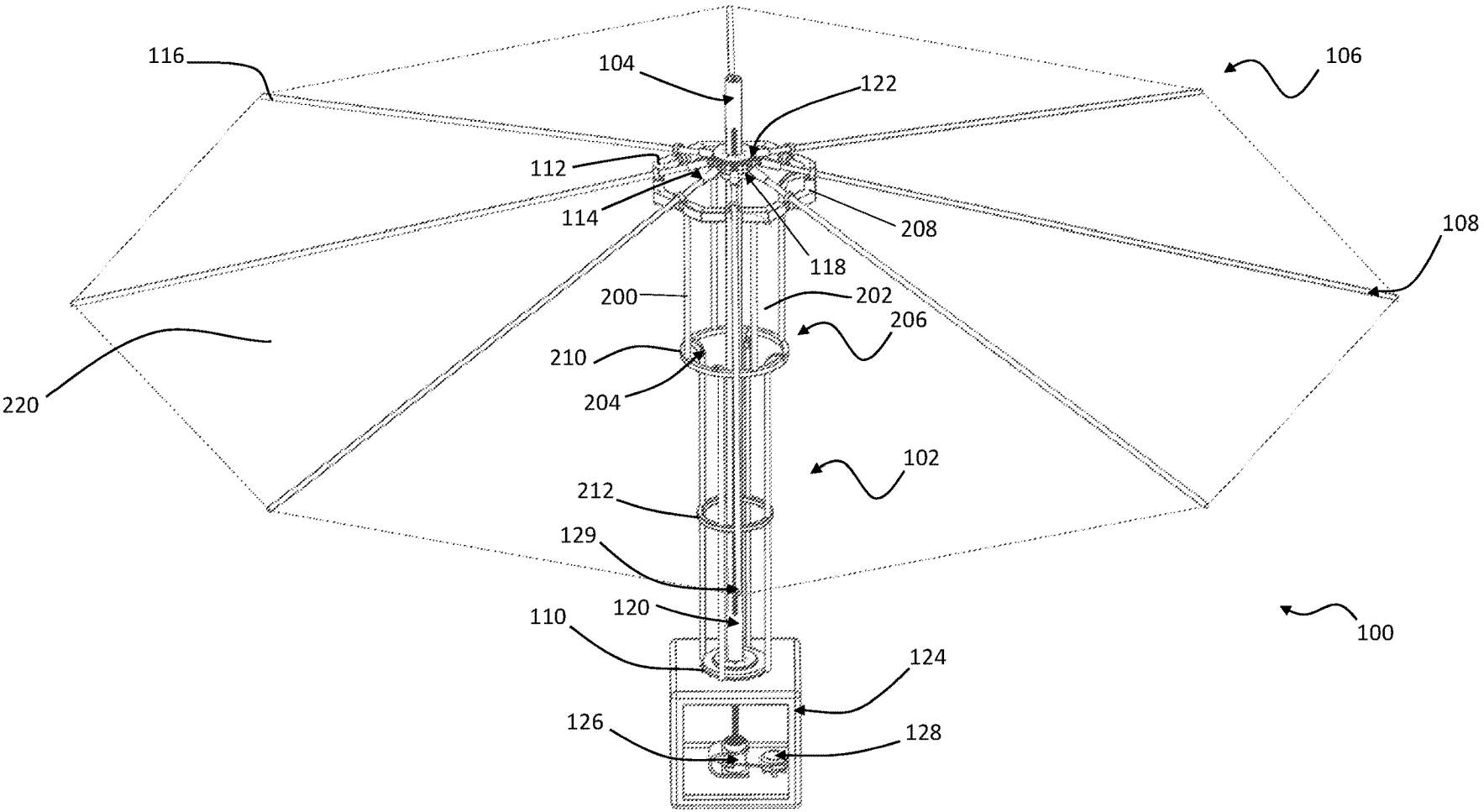
FIG. 1F is a front perspective view of the embodiment of the retractable umbrella frame device of FIG. 1E, shown with an umbrella canopy connected.

An example of the retractable umbrella frame device 100 with an umbrella canopy 220 installed is shown in FIG. 1F, shown in phantom line to allow for enhanced visibility of the various features. FIG. 1F shows the retractable umbrella frame device 100 comprising the same features as shown in FIG. 1E, including: the base body structure 102 (spanning a length from the first end 110 to the second end 112), the internal axis structure 104, the skeletal umbrella frame structure 106, the arms 108 (comprising connected ends 114 and free ends 116), the hub structure 118, the first stop structure 120, the second stop structure 122, the mounting base 124 (which comprises the actuation mechanism 126 and the electronic control features 128), the moveable component 129, solid base body support walls 200, open portions 202 of the base body structure 102, a tapering point 204, and secondary support structures 206 (including a first ring 208, a second ring 210 and a third ring 212).

The umbrella canopy 220 can comprise any material capable of blocking water, sun and/or any other undesirable environmental conditions, and can comprise any material known for use as the tarp or canopy portion of umbrellas. In some embodiments, the canopy 220 can comprise cloth. In some embodiments, the canopy 220 can comprise a flexible material and can remain connected to the skeletal umbrella frame structure 106 during the retraction and extension of the retractable umbrella frame device 100, even remaining connected to the skeletal umbrella frame structure 106 when the retractable umbrella frame device 100 is in its fully retracted state. To facilitate these embodiments, wherein the umbrella canopy 220 is constantly connected to the skeletal umbrella frame structure 106, the umbrella canopy 220 can further comprise additional features such as slits as will be described further herein.

It is understood that the retractable umbrella frame device 100 does not require a constantly connected umbrella canopy and can function simply as a retractable frame structure for any purpose a user can utilize it for. In some embodiments, a user operated the retractable umbrella frame device 100 until it is in its fully extended position as shown in FIG. 1E and then can connect or place on his or her own separate canopy to be supported by the skeletal umbrella frame structure 106. In these embodiments, the user can simply remove the canopy before retracting the retractable umbrella frame device 100 In some embodiments, the user can utilize the retractable umbrella frame device 100 as a tent structure.

Figure 1G:
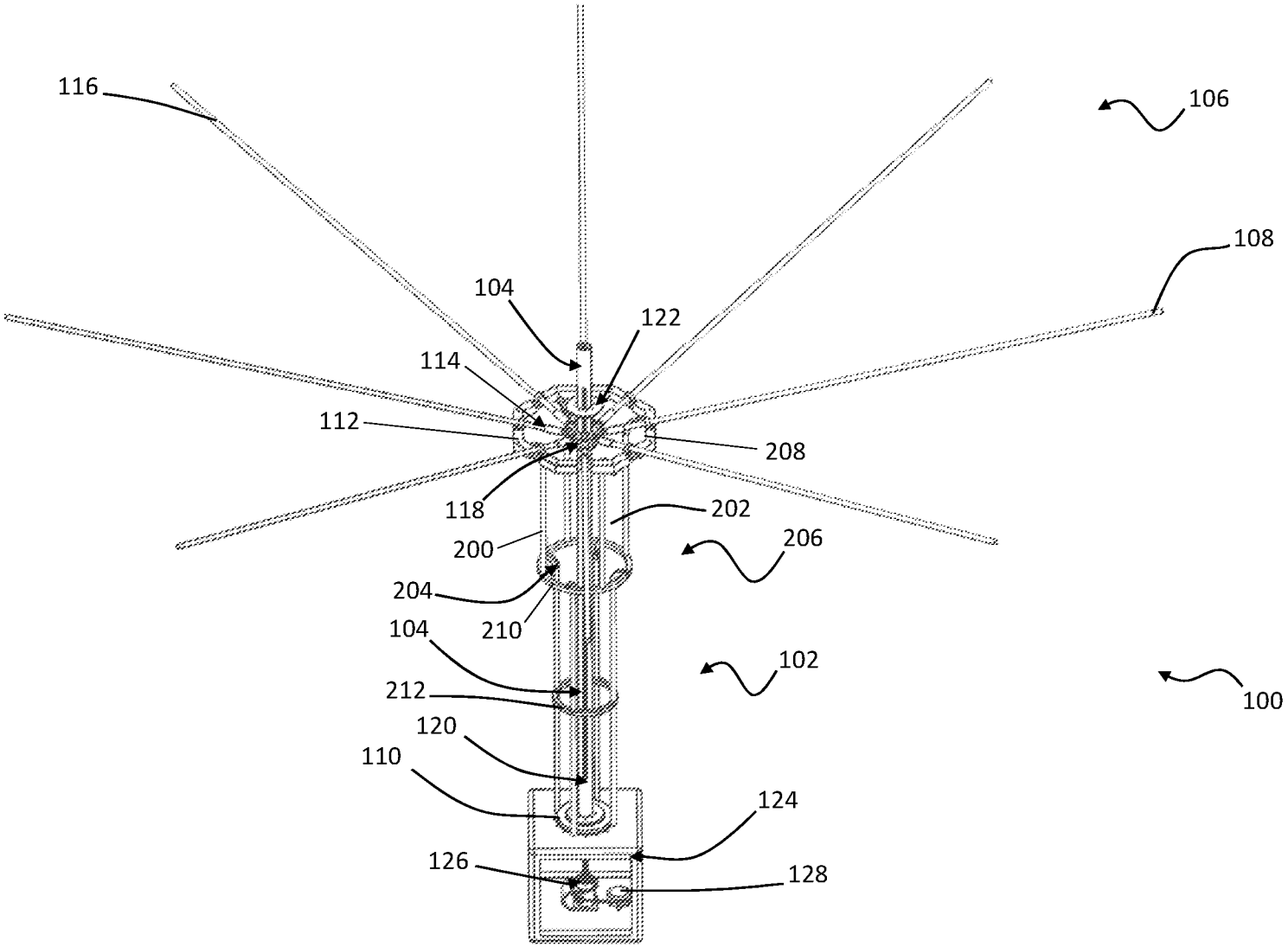
FIG. 1G is a front perspective view of the embodiment of the retractable umbrella frame device of FIG. 1E, shown in a different orientation.
Figure 1H:
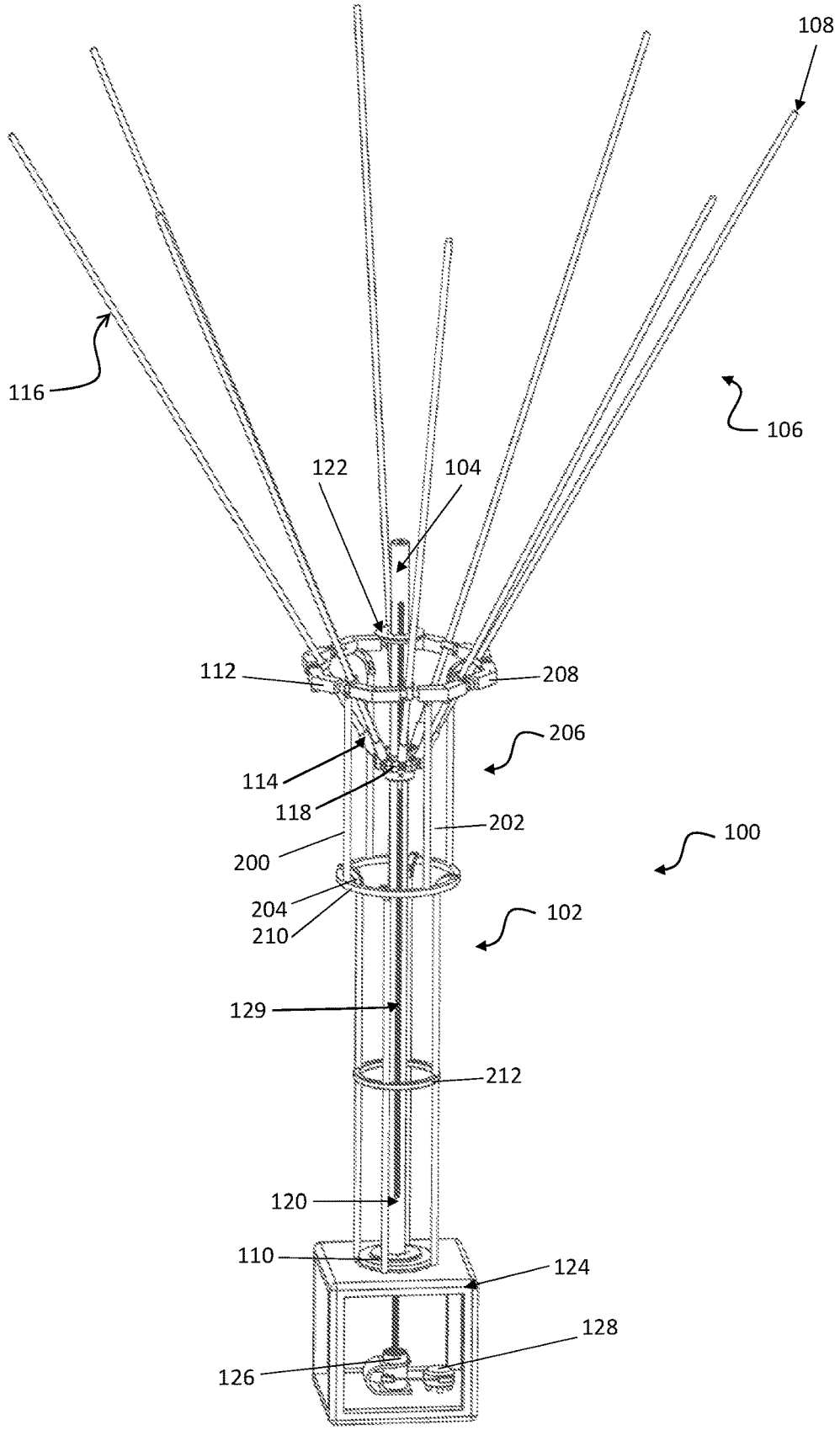
FIG. 1H is a front perspective view of the embodiment of the retractable umbrella frame device of FIG. 1G, shown in a different orientation.
Figure 1I:
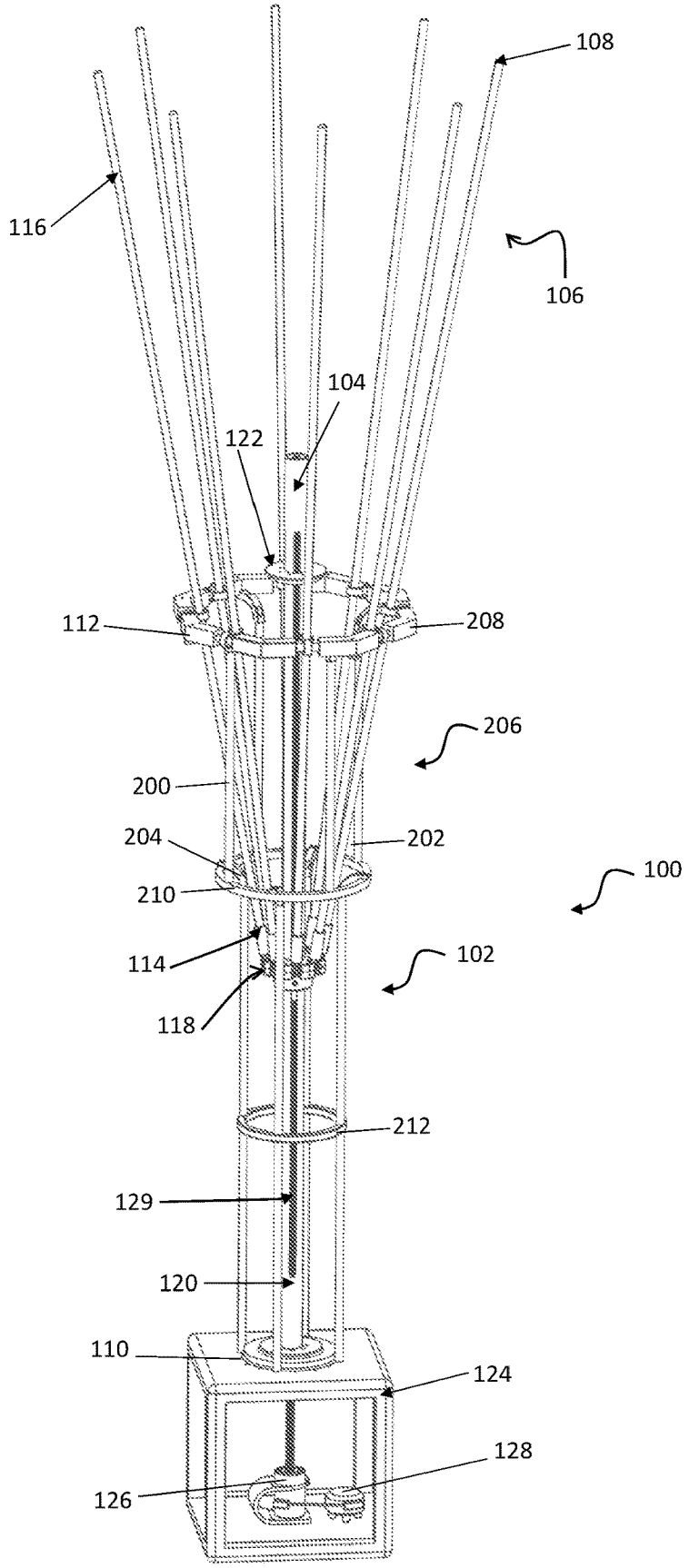
FIG. 1I is a front perspective view of the embodiment of the retractable umbrella frame device of FIG. 1H, shown in a different orientation.

A perspective view of the inverse process of the extension of the retractable umbrella frame device 100 shown in FIGS. 1A-1E (i.e. the retraction process) is shown in FIGS. 1G-1I which, like in FIG. 1E, show the retractable umbrella frame device 100 can comprise the base body structure 102 (spanning a length from the first end 110 to the second end 112), the internal axis structure 104, the skeletal umbrella frame structure 106, the arms 108 (comprising connected ends 114 and free ends 116), the hub structure 118, the first stop structure 120, the second stop structure 122, the mounting base 124 (which comprises the actuation mechanism 126 and the electronic control features 128), the moveable component 129, solid base body support walls 200, open portions 202 of the base body structure 102, a tapering point 204, and secondary support structures 206 (including a first ring 208, a second ring 210 and a third ring 212).

Figure 1J:
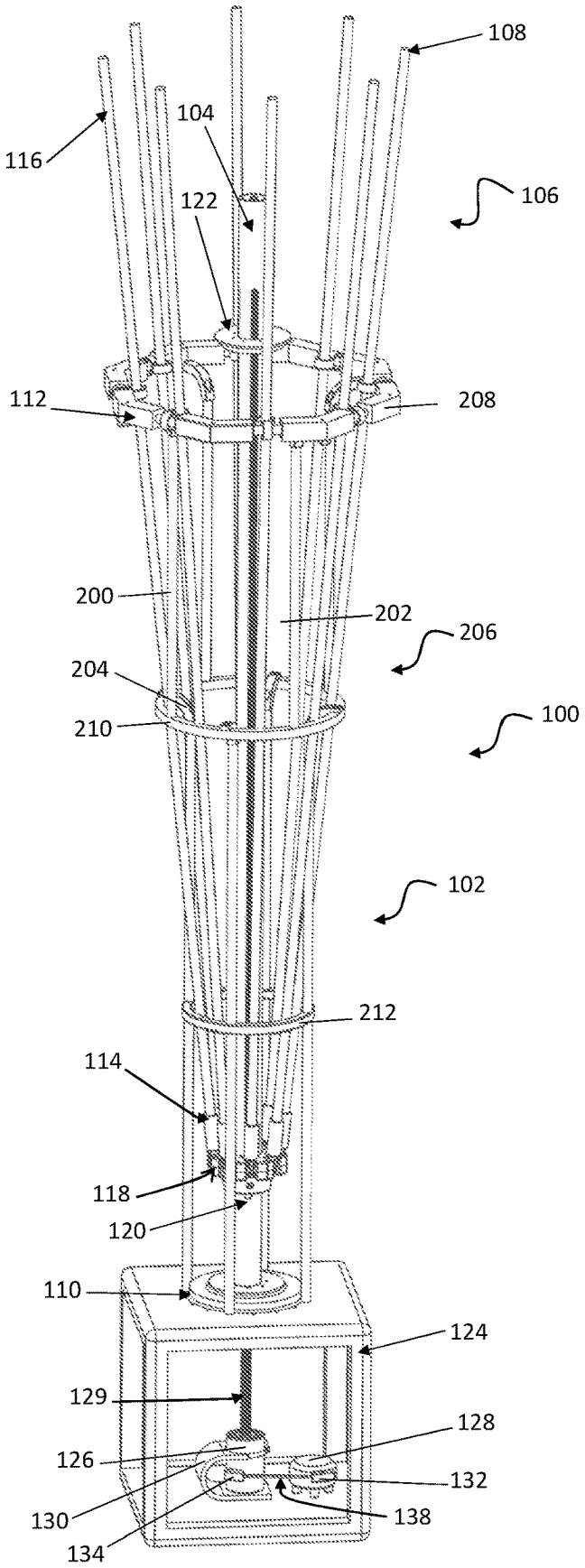
FIG. 1J is a front perspective view of the embodiment of the retractable umbrella frame device of FIG. 1J, shown in a different orientation.

FIG. 1G shows the arms 108 beginning to retract back into the base body structure 102. FIG. 1H shows the hub 118 moving along the internal axis structure 104 toward the first end 110 of the base body structure 102 causing the arms 108 to further retract into the base body structure 102 and causing the angles of connection between the connected ends 114 of the arms 108 to change to accommodate the change in position of the arms 108. FIG. 1I shows the hub 118 moving even further along the internal axis structure 104 toward the first end 110 of the base body structure 102 causing the arms 108 to even further retract into the base body structure 102 and causing the angles of connection between the connected ends 114 of the arms 108 to change even more to accommodate the change in position of the arms 108. Finally, FIG. 1J shows the retractable umbrella frame device 100 in its fully retracted state akin to FIG. 1A.

Figure 1K:
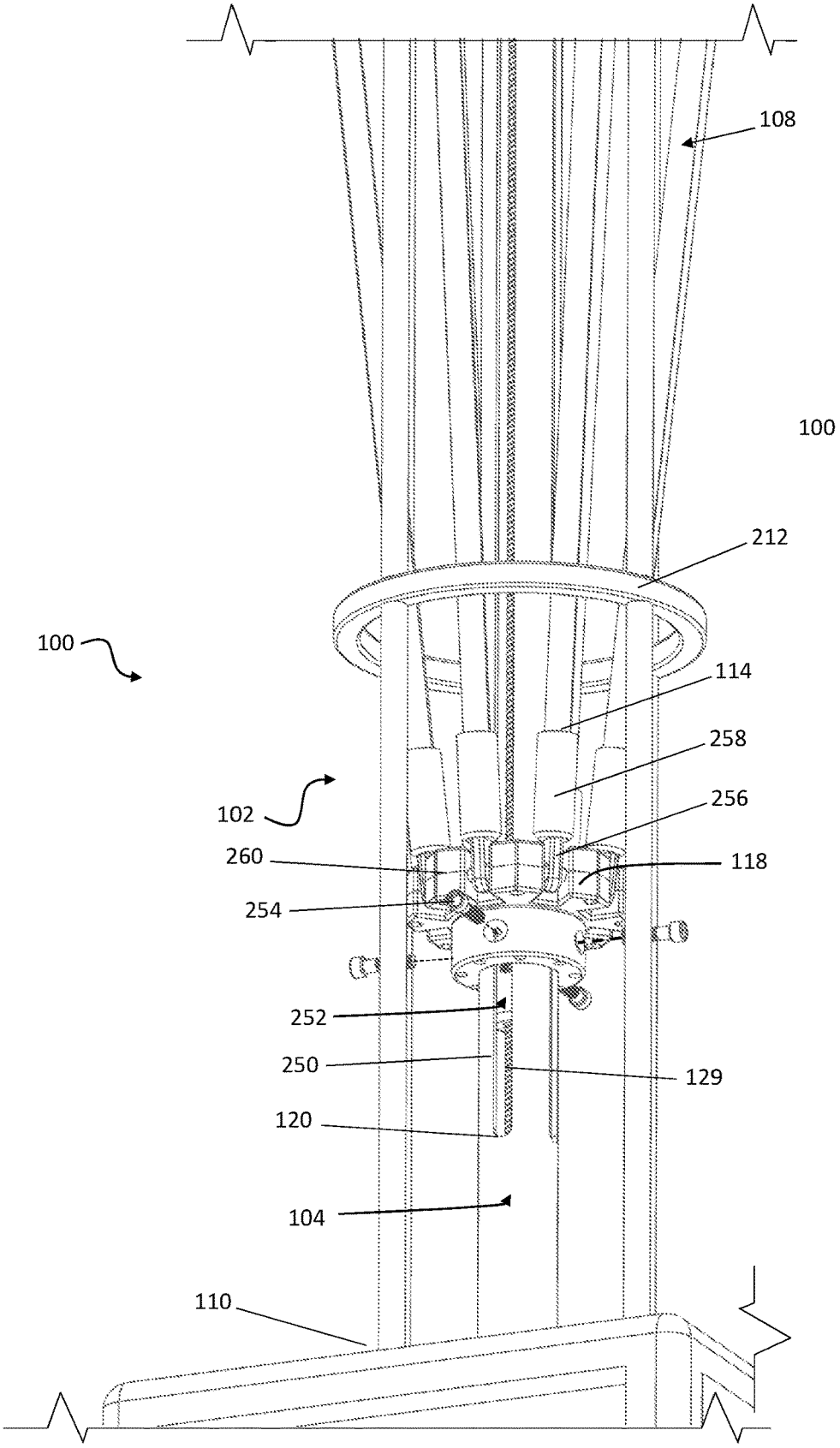
FIG. 1K is a zoomed-in partial front bottom perspective view of the retractable umbrella frame device of FIG. 1A.

The structure and function of the hub portion 118 and the moveable component 129 are better described in FIG. 1K, which shows a zoomed in view of the retractable umbrella frame device 100 in a nearly retracted state, including the base body structure 102, the internal axis structure 104, the arms 108 (with their connected ends 114), the first end 110 of the base body portion 102, the hub 118, the first stop structure 120, the moveable component 129, and the third ring 212. FIG. 1K further shows an access opening 250, which is configured such that a portion of the hub 118 can be connected to the moveable component 129. As described above, the moveable component 129 in this embodiment is a threaded lead screw, which can be in communication with an actuator mechanism, which can be electronic, automated or manual. The threads on the lead screw can interact with other structures to "climb" up or down the internal axis structure 104 and move the hub 118.

While this specific embodiment discloses a moveable component 129 as a threaded lead screw, it is understood that any moveable component 129 that can connect to the hub 118 and/or the arms 108 and move along the length of the internal axis structure 104, therefore imparting similar movement to the hub 118 and/or arms 108, is within the scope of this disclosure. Some example moveable components 129 include, but are not limited to, chain structures, pully structures, rope structures, sliding structures, belt structures and/or combinations thereof.

In the embodiment shown, the moveable component 129 is connected to an internal base nut 252, which is configured to move along with the moveable component 129. A portion of the hub 118 can be connected to the internal base nut 252, utilizing any known connection structure. In the embodiment shown, a connection element 254 is utilized which is configured to connected the hub 118 to the internal base nut 252 through the access opening 250 (the travel through the access opening is shown in phantom lines), such that movement of the moveable component 129 causes like movement of the internal base nut 252, which will in turn cause movement of the hub 118. Any known connection element can be utilized. In some embodiments, a simple screw connection is utilized.

It is understood that while some embodiments utilize this specific connection, in other embodiments the hub 118 or the internal nut structure 252 is not utilized. In some embodiments, the arms 108 can be moveably connected directly to the internal nut structure 252 or the moveable component 129. One advantage of utilizing the hub 118 being connected the the internal nut structure 252 through the access opening 250 is that the connection element 254 can abut against the first strop structure 120, which is also an end of the access opening 250. This will prevent any further movement of the hub 118 toward the first end 110 of the base body structure 102.

One advantage of utilizing the hub 118 is that moveable connections of the arms 108 to the moveable component 129 are facilitated, allowing for the arms 108 to change angles in relation to the hub 118. The hub 118 can comprise one or more moveable connection points 256, which are configured such that arms 108 connected to the moveable connection points 256 can change their angle of connection in relation to the hub 118. In some embodiments, the arms 108 themselves can be directly connected to the hub 118 via the moveable connection points 256, for example, the arms 108 can comprise a hook structure that can loop around the moveable connection points 256.

In other embodiments, for example, the embodiment shown in FIG. 1K, the arms 108 are connected to the moveable connection points 256 via intermediate connection structures 258. As shown in FIG. 1K, the intermediate connection structures 258 are moveably connected at one end to the moveable connection point 256 of the hub 118 and have a second receptacle end that is configured to receive an arm 108, for example, by comprising a diameter slightly larger than the diameter of the arm 108 so as to snugly fit around the arm 108. In other embodiments, the arms 108 can be hollow with a diameter large enough to fit around the diameter of the intermediate connection structures 258.

The moveable connections between the arms 108 and the moveable connection point 256 of the hub 118, whether made directly or through the intermediate connection structures 258, can be formed utilizing any known connection structure that allows the angle of the arms 108 in relation to the hub 118 to change as the hub 118 moves along the internal axis structure 104. In some embodiments, the moveable connection is a traditional hinge structure. In some embodiments, the moveable connection is a living hinge structure. In some embodiments, the moveable connection is a ball-and-socket structure. In some embodiments, the moveable connection is a pressure-fit structure configured to move when sufficient force is applied and not move in absence of such force.

At least some advantages of utilizing the intermediate connection structures 258 include that the arms 108 can more easily be assembled, dissembled and replaced as rather than directly moveably attach the arms 108 to the moveable connection point 256 of the hub 118, the more complex moveable connection is made via permanently or semi-permanently attached intermediate connection structures 258 and the arms 108 can simply fit into these intermediate connection structures 258 through simple connections, for example, simple press-fit or snap-fit connections.

Another advantage of utilizing the intermediate connection structures 258 is that greater control can be exerted over the angle of the arms 108 in relation to the hub 118 as the hub 118 moves toward and away from the first end 110 of the base body structure 102. For example, in addition to the moveable connection points 256, the hub can comprise extended portions 260 which can extend outward from the hub 118 to a greater extent than the moveable connection points 256 such that the extended portions 260 abut up against a portion of the intermediate connection structures 258 as shown in FIG. 1K.

When the hub 118 moves along the length of the internal axis structure 104, the extended portions of the hub 118 that abut against the portions of the intermediate connection structures 258 can push against these portions of the intermediate connection structures 258 and guide the movement of the intermediate connection structures 258 toward a desired angle in relation to the hub 118, for example, causing the intermediate connection structures 258 to move from their resting almost orthogonal position pointed upward to travel to an almost horizontal position and to move further downward when nearly fully extended when the hub 118 has traveled far enough away from the first end 110 of the base body structure 102.

Figure 1L:
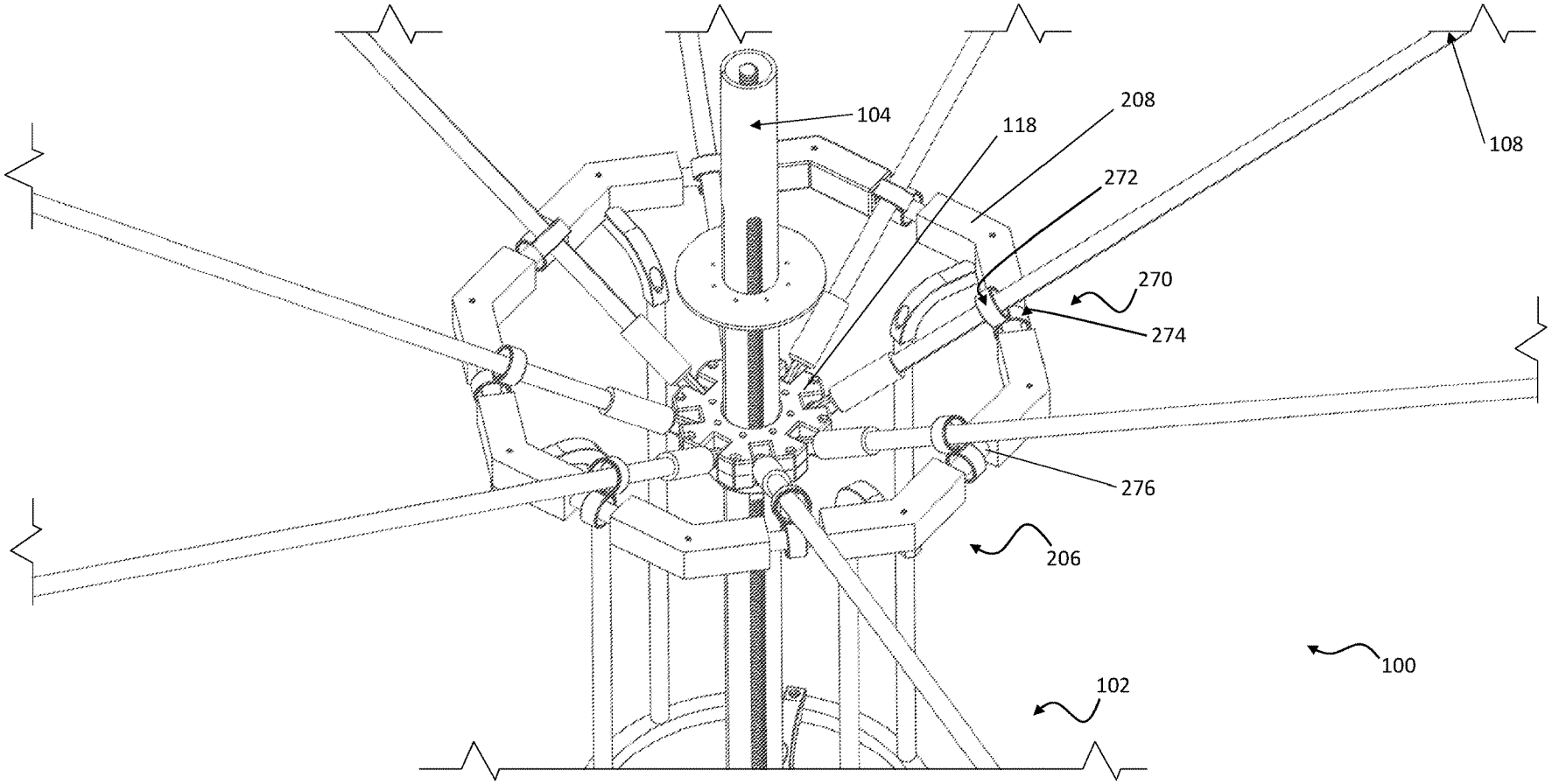
FIG. 1L is a partial front top perspective view of the retractable umbrella frame device of FIG. 1A, showing additional features.
Figure 1M:
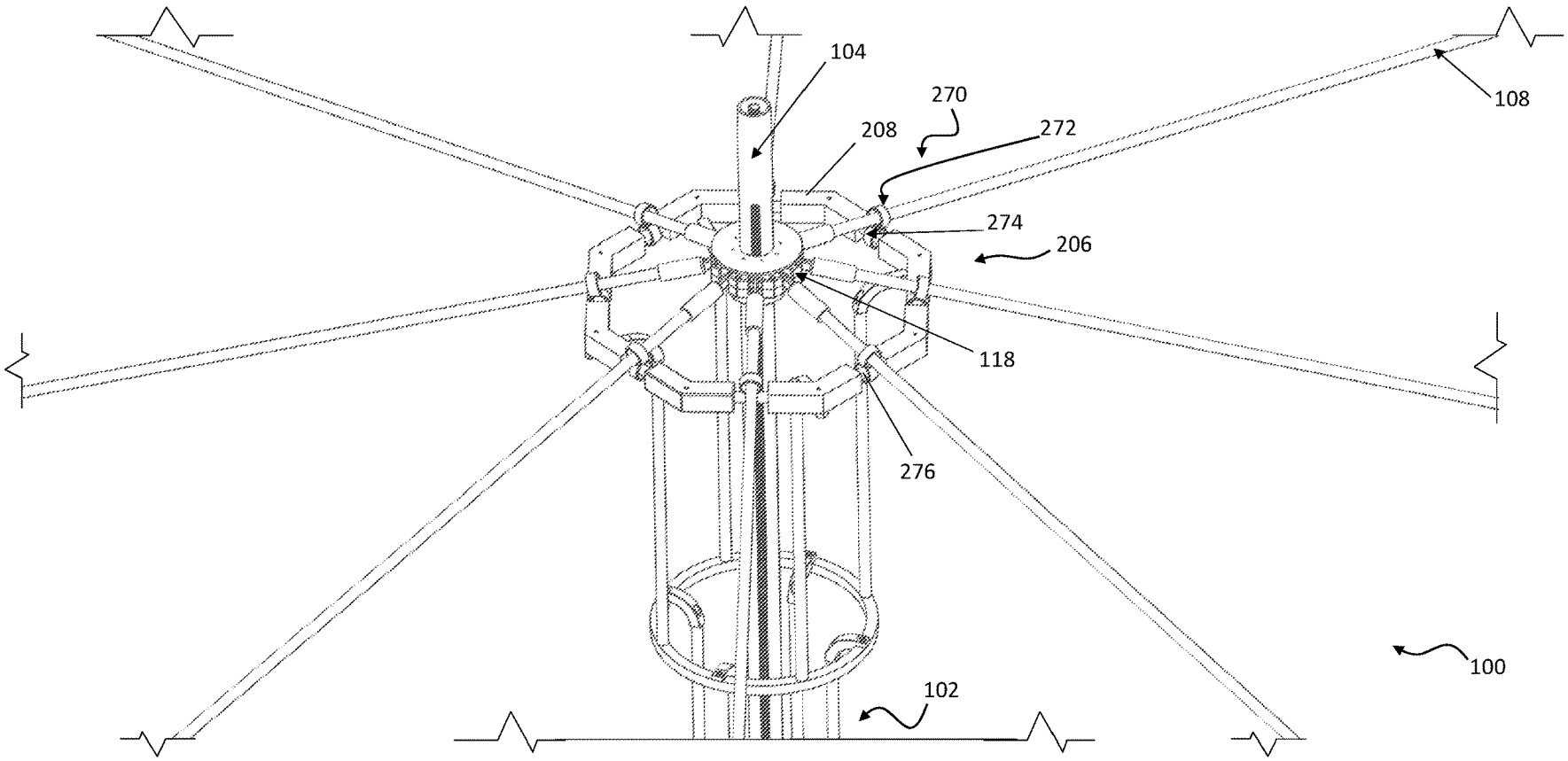
FIG. 1M is a partial front top perspective view of the retractable umbrella frame device of FIG. 1L, shown in a different orientation.

Additional guide structures 270 are shown in FIGS. 1L and 1M which, show a zoomed in portion of the Embodiment of FIG. 1E. Like in FIG. 1E, the retractable umbrella frame device 100 can comprise the base body structure 102, the internal axis structure 104, the arms 108, the hub structure, and secondary support structures 206 (including a first ring 208). Some of the other features previously described have had their reference numbers omitted from this drawing in order to better show the newly described optional features herein.

The additional guide structures 270 can be connected to one of the secondary support structures 206, for example, the first ring 208 as shown in FIGS. 1L and 1M, or can be connected to another portion of the base body structure 102. In some embodiments, including the embodiments shown in FIGS. 1L and 1M, the guide structures 270 can comprise an engaging guide portion 272 and a base body connected guide portion 274, which can be connected to the secondary support structure 206 at a guide structure connection point 276.

In some embodiments, including the embodiments shown in FIGS. 1L and 1M, the secondary support structures 206 can comprise a thinner portion configured as a guide structure connection point 276. The guide structures 270 can comprise a structure with at least two rings that are connected such that the opening of one ring is offset from the opening of another ring as shown in FIGS. 1L and 1M. One ring portion of the guide structure 270 can comprise an engaging guide portion 272, which is configured such that an arm 108 can be placed through the opening of the ring-like engaging guide portion 272. The second offset ring portion of the guide structure 270 can be configured as a base body connected guide portion 274 and can be connected to the guide structure connection point 276.

The guide structures 270 are configured such that the engaging guide portion 272 can control and guide the extension of the arms 108 through the engaging guide portion 272 and the base body connected guide portion 274 is moveably connected to guide structure connection point 276, such that the guide structures 270 can move with the angle of the arms 108 as it changes in relation to the hub 118. As shown in the advancement of the hub 118 toward the top of the internal axis structure 104, when viewing the progression from FIG. 1L to FIG. 1M, the angle of the arms 108 in relation to the hub 118 changes such that the arms that were pointed upward are now point downward. The base body connected guide portion 274 moves about the guide structure connection point 276, allowing the engaging guide portion 272 to move and still surround a connected arm 108, guiding the arm 108 in a desired direction without unnecessarily restricting the angle of connection between the arm 108 and the hub 118.

Figure 2A:
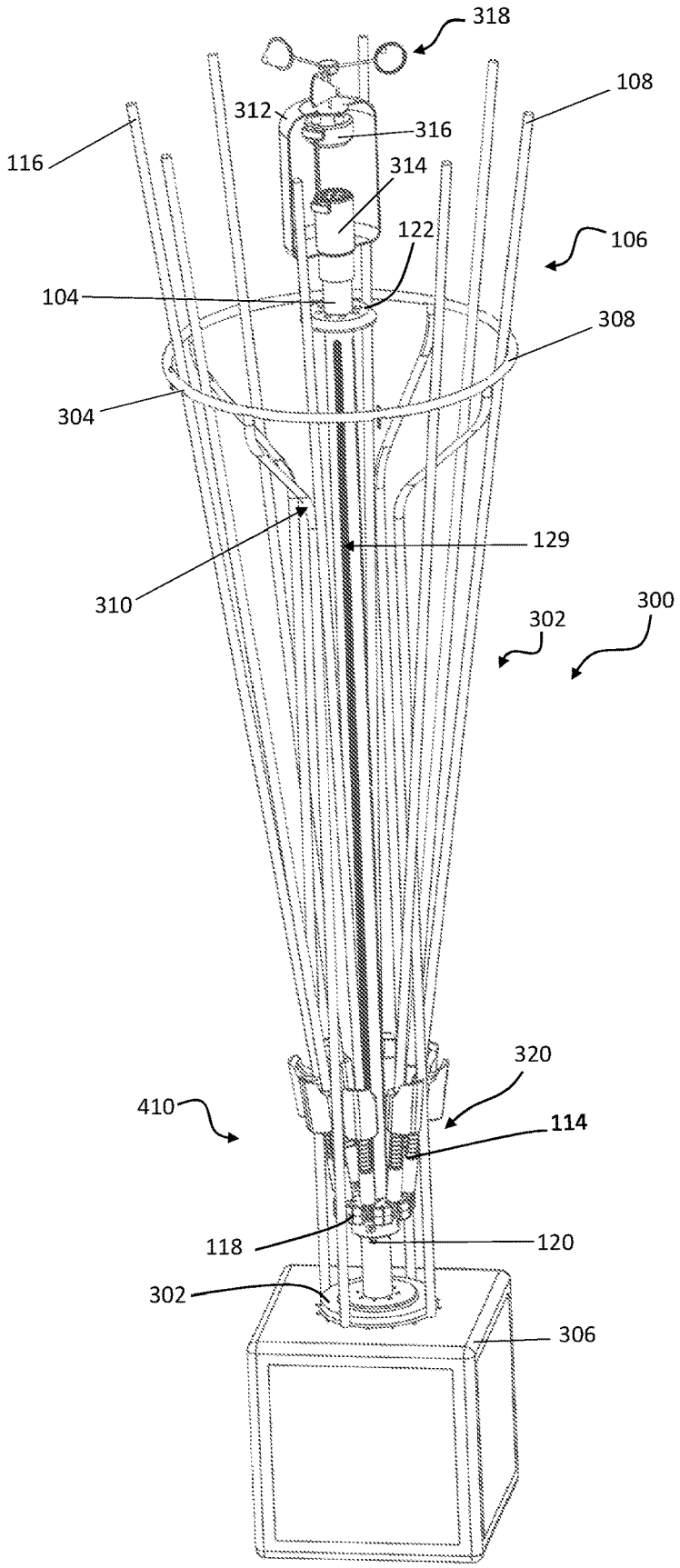
FIG. 2A is a front view of a second embodiment of a retractable umbrella frame device incorporating features of the present invention.
Figure 2B:
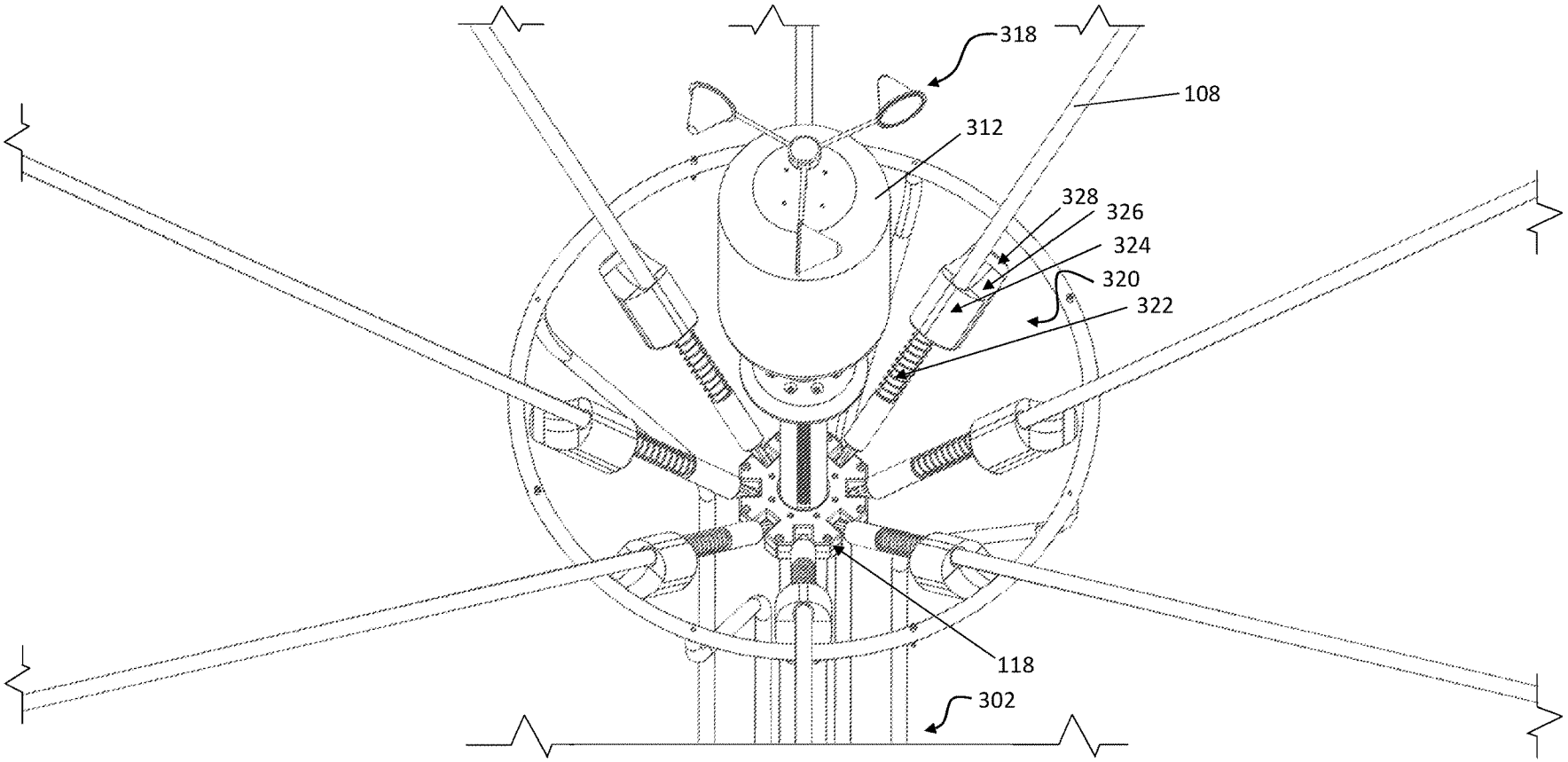
FIG. 2B is a partial front top perspective view of the retractable umbrella frame device of FIG. 2A, showing additional features.
Figure 2C:
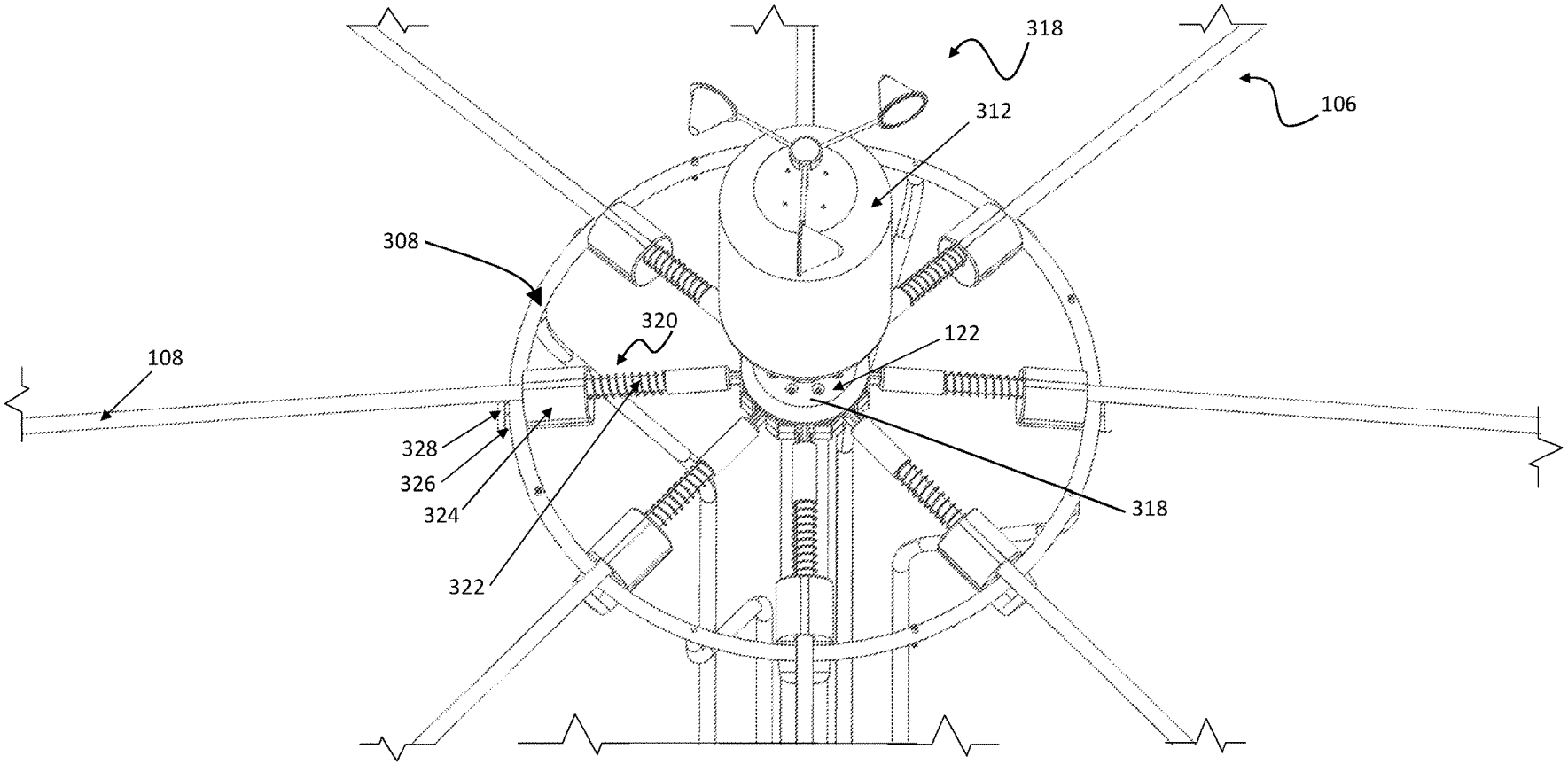
FIG. 2C is a partial front top perspective view of the retractable umbrella frame device of FIG. 2B, shown in a different orientation.

Retractable umbrella devices incorporating features of the present invention can comprise many different additional features. For example, some device incorporating features of the present invention can incorporate different base body structures and/or guide structures. An example of such an embodiment is shown in FIGS. 2A-2C. FIG. 2A shows a retractable umbrella frame device 300, similar to the retractable umbrella frame device 100 in FIGS. 1A-1M above, wherein like reference numbers are utilized to denote like features. Like with FIGS. 1A-1M, the retractable umbrella device of FIG. 2A comprises a base body structure 302 (spanning a length from a first end 303 to a second end 304), the internal axis structure 104, the skeletal umbrella frame structure 106, the arms 108 (comprising connected ends 114 and free ends 116), the hub structure 118, the first stop structure 120, the second stop structure 122, a mounting base 306, and the moveable component 129. All these features with like reference numbers can be configured and operated similarly to the embodiment in FIGS. 1A-1M.

Unlike the embodiment in FIGS. 1A-1M, the base body structure 302 comprises a different shape, and utilizes only one ring-like secondary support structure 308. The embodiment of FIG. 2A comprises a tapering point 310, where the base body structure 302 curves and tapers in diameter. Furthermore, also unlike the embodiment in FIGS. 1A-1M, the mounting base 306 does not comprise an actuator mechanism or electronic control features. Instead, these control features are housed within a control unit 312, which can comprise an actuator 314 similar to the actuator 126 in the embodiment of FIGS. 1A-1M above. Although control unit 312 is shown positioned at the top of the internal axis structure 104 (near the first end 304 of the base body structure 302), the control unit can be placed in or connected to different portions of the retractable umbrella frame device 300, for example being placed into a middle portion of the internal axis structure 104 or placed into or connected to the secondary support structure 308.

The control unit 312 can further house electronic control features 316 or power features, which can be similar to the electronic control features 128 and power features discussed in regard to the embodiment of FIGS. 1A-1M above. It is understood that while the embodiment of FIG. 2A utilizes a control unit 312 rather than a mounting base with control features, embodiments incorporating features of the present invention can utilize either a control unit or a mounting base with control features, or in in some embodiments, both a control unit and a mounting base with control features.

Another additional feature of the embodiment shown in FIG. 2A, and some other embodiments incorporating features of the present invention, is the optional incorporation of a wind speed detector 318. The wind speed detector 318 can function as a "weather vane" type device and can spin when contacted by a wind of sufficient speed and strength. The wind speed detector 318 can then communicate wind speed information to the electronic control features 316 in the control unit 312. When a sufficient wind speed has been reached that the retractable umbrella frame device 300, or a connected umbrella canopy, is in danger of being damaged by the strong wind, the electronic control features 316 can be configured to communicate with the actuator 314 to automatically retract the umbrella frame to avoid damage. In some embodiments, when the wind speed detector 318 detects that the wind in no longer strong enough to damage the retractable umbrella frame device 300, or a connected umbrella canopy, the electronic control features can be configured to communicate with the actuator 314 to automatically extend the umbrella frame.

Another difference between the embodiment of FIGS. 1A-1M and the embodiment of FIG. 2A is that the embodiment of FIG. 2A utilizes different piston-like guide structures 320. These guide structures 320 are shown more clearly in FIGS. 2B-2C, which shows the arms 108, the hub 118, the base body structure 302, the secondary support structure 308, the control unit 312, and the guide structures 320. The guide structures 320 can comprise a bias mechanism 322, a guide body portion 324, a contact surface 326 and a protruding portion 328. The guide structures are configured to fit around the arms 108, for example, by comprising a hollow portion through the guide body portion 324 through which an arm 108 can be placed. The bias mechanism 322 is configured to bias the guide body portion 324 of the guide structure 320 away from the hub 118, to help control the angle of connection in between the arms 108 and the hub 118. The bias mechanism can comprise a spring or other resilient body or any known biasing structure.

The contact surface 326 of the guide structures 320 is configured to press against the secondary support structure 308, such that the protruding portion 328 and a connected arm 108 can effectively "trap" a portion of the secondary support structure 308 between the protruding portion 328 and the arm 108 when the contact surface 326 of the guide structure 320 is pressed against the secondary support structure 308. When the hub 118 moves upward and transitions the retractable umbrella frame device 300 toward the extended position (similarly to the operation of the embodiment in FIGS. 1A-1M), as is seen when viewing the progression of the hub 118 between FIG. 2B and FIG. 2C, the contact surfaces 326 of the guide structures 320 move into contact with the secondary support structure 308 and along with the bias created by the bias mechanism 322 and the trapping of the secondary support structure 308 between a connected arm 108 and the guide structure protruding portion 328, the angle of connection between the arms 108 and the hub 118 are changed and the guide structures 320 can adapt to this change in angle while still guiding the arms 108 in a desired position.

Additional base body structures incorporating features of the present invention are possible. Another example variant of a base body structure for a retractable umbrella frame device 400 is shown in FIGS. 3A-3B. FIG. 3A shows a retractable umbrella frame device 400, similar to the retractable umbrella frame device 100 in FIGS. 1A-1M and FIG. 2A-2C above, wherein like reference numbers are utilized to denote like features. Like with FIGS. 1A-1M and 2A-2C, the retractable umbrella device of FIG. 3A comprises a base body structure 402 (spanning a length from the first end 403 to the second end 404), the internal axis structure 104, the skeletal umbrella frame structure 106, the arms 108 (comprising connected ends 114 and free ends 116), the hub structure 118, the first stop structure 120, the second stop structure 122, the mounting base 306, the moveable component 129, the guide structures 270, the control unit 312 (comprising an actuator 314 and electronic control features 316). All these features with like reference numbers can be configured and operate similarly to the embodiment in FIGS. 1A-1M and FIGS. 2A-2C.

Unlike in FIGS. 1A-1M and FIGS. 2A-2C the retractable umbrella frame device 400 in FIG. 3A comprises a different base body structure 402, which has a solid walled structure 405 and slit openings 406 in which the arms 108 can rest when the retractable umbrella device 400 is in its retracted state with the hub 118 near the first end 403 of the base body structure 402. The slit openings 406 can be configured between the solid walled structures 405. Like in the embodiment of FIG. 2A-2C, the embodiment of FIG. 3A-3B comprises a single ring-like secondary support structure 408, although it is understood that multiple secondary support structures or no secondary support structures can be utilized and that the secondary support structure 408 can comprises any suitable shape as the secondary support structures 206, 308 in the other embodiments described herein.

The alignment between the arms 108 and the slit openings 406 can be more clearly seen in FIG. 3B, which shows the retractable umbrella frame device 400 comprising the internal axis structure 104, the hub 118, the arms 108, the guide structure 270 (comprising the engaging guide portion and the base body connected guide portion), the control unit 312, the base body structure 402, the solid walled structures 405, the slit structures 406, and the secondary support structure 408. FIG. 3B shows how the slit openings 406 can be aligned with the arms 108, which can provide further control to the positioning of the arms and facilitate a smooth transition of the arms 108 between their extended and retracted states.

Figure 4:
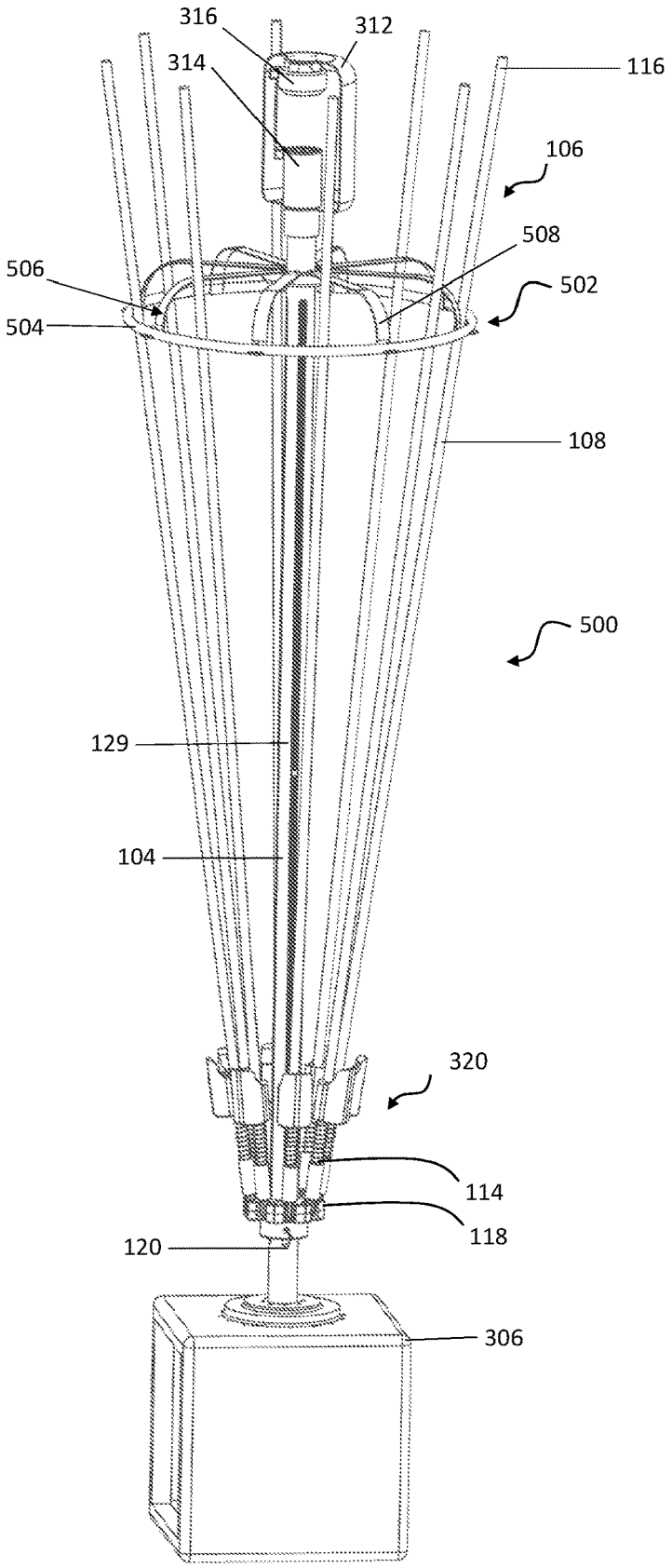
FIG. 4 is a front view of a fourth embodiment of a retractable umbrella frame device incorporating features of the present invention.

Still another variation in the design of a base body structure is set forth in FIG. 4. FIG. 4 shows a retractable umbrella frame device 500, similar to the retractable umbrella frame device 100 in FIGS. 1A-1M, FIG. 2A-2C, and the retractable umbrella frame device 400 FIGS. 3A-3B above, wherein like reference numbers are utilized to denote like features. Like with the embodiments discussed above, the retractable umbrella device of FIG. 4 comprises a base body structure 502, the internal axis structure 104, the skeletal umbrella frame structure 106, the arms 108 (comprising connected ends 114 and free ends 116), the hub structure 118, the first stop structure 120, the mounting base 306, the moveable component 129, the control unit 312 (comprising an actuator 314 and electronic control features 316) the piston-like guide structures 320. All these features with like reference numbers can be configured and operate similarly to the embodiment in FIGS. 1A-1M, FIGS. 2A-2C and FIGS. 3A-3B.

Unlike the other embodiments above, the retractable umbrella frame structure 500 in FIG. 4 comprises a smaller single base body structure 502, which comprises a secondary support structure 504, similar to the secondary support structures 206, 308 described above, and a support cage 506, connected to portions of the secondary support structure 504 to provide additional support to the secondary support structure 504. Like with the secondary support structures 206, 308 discussed above, the secondary support structure 504 in FIG. 4 provides a perimeter for the arms 108 to rest and abut against. The support cage 506 provides additional support for the secondary support structure 504, as well as serving to further separate and organize adjacent arms 108. The piston-like guide structures 320 function similarly to those in FIGS. 2A-2C above and interact with the secondary support structure 506 similarly to how the piston-like support structures 320 in FIGS. 2A-2C interact with the secondary support structure 308 in FIGS. 2A-2C.

The support cage 506 can comprises one or more support struts 508, with the embodiment shown in FIG. 4 comprising a plurality of support struts 508. At least one support strut 508 in the support cage 506 can function to secure the secondary support structure 504 to the internal axis structure 104, such that the secondary support structure 504 at least partially surrounds the internal axis structure 104. In some embodiments, including the embodiment shown in FIG. 4, at least one support strut 508 can secure the secondary support structure 504 by being connected to the secondary support structure 504 at a first end and by being connected to the internal axis structure 104 at a second end. In some embodiments, the support cage 506 can function as the second stop structure (similar to the second stop structure 122 in the embodiment of FIGS. 1A-1M above).

Figure 5A:
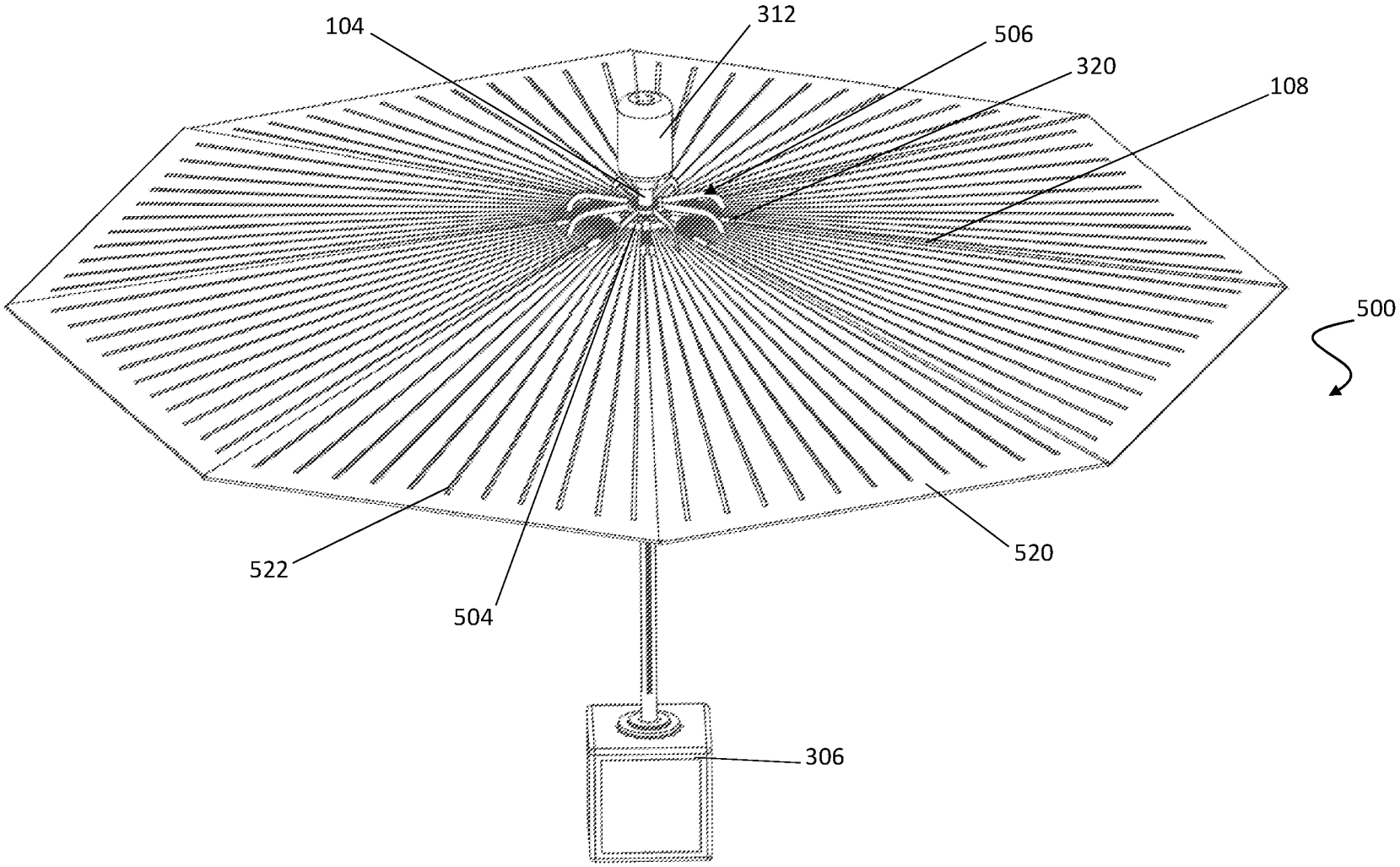
FIG. 5A is a front perspective view of the embodiment of a retractable umbrella frame device of FIG. 4 shown with a specialized umbrella canopy connected thereto.
Figure 5B:
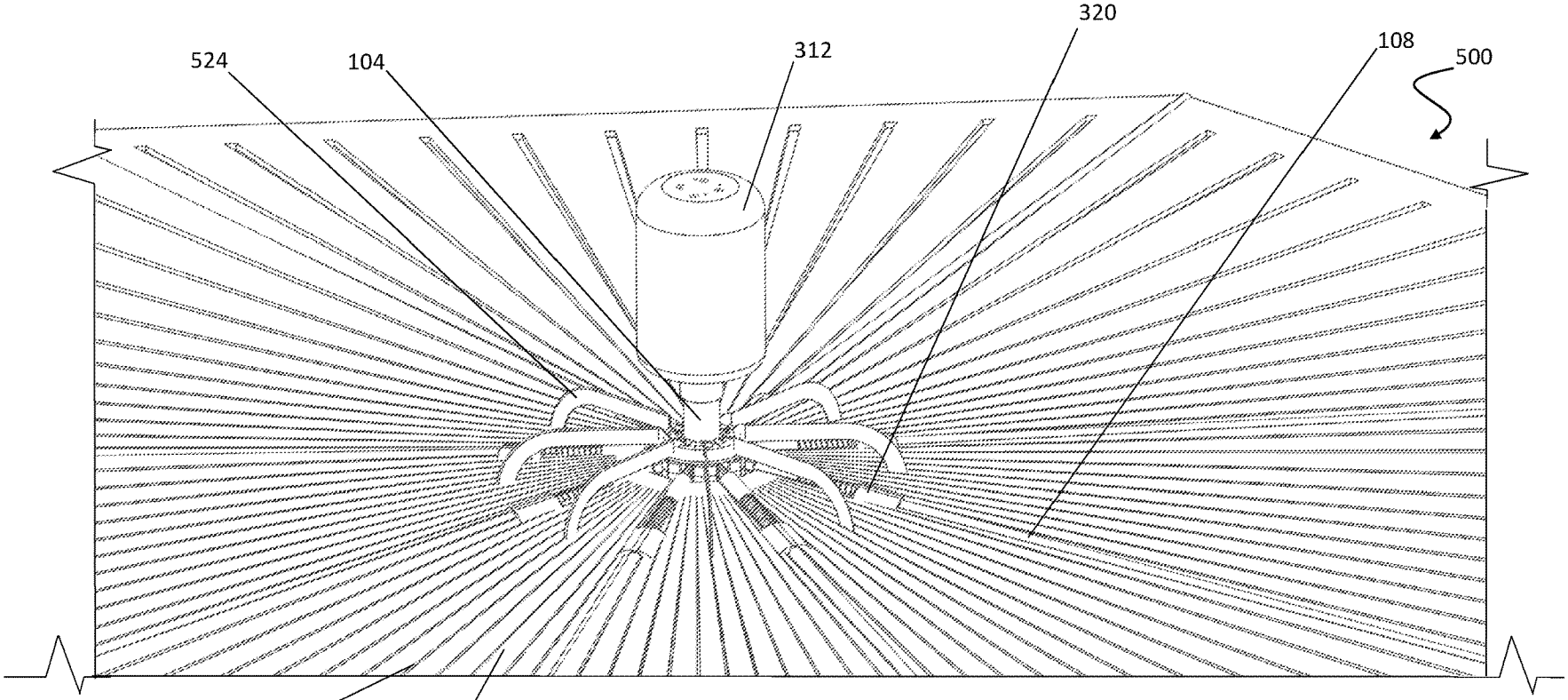
FIG. 5B is a partial front top perspective view of the embodiment of a retractable umbrella frame device of FIG. 5A.

Due to the nature of the support cage 506 being positioned above the secondary support structure 504 in FIG. 4, a specialized umbrella canopy is ideal for use with this embodiment. FIGS. 5A and 5B show such a specialized umbrella canopy 520 integrated into the retractable umbrella device 500, along with the internal axis structure 104, the arms 108, the mounting base 306, the control unit 312, and the support cage 506 (the secondary support structure 504 and other features not being visible due to the umbrella canopy 520) and the guide structures 320 (not shown in FIG. 5B). The umbrella canopy 520 of FIG. 5 is similar to the umbrella canopy 220 shown in FIG. 1F.

However, the umbrella canopy 520 of FIG. 5A additionally comprises one or more canopy slits 522, which can be an omission or otherwise removed or perforated section in the material of the canopy 520. These canopy slits 522 can be aligned with portions of the support cage 506 and/or the arms. This allows for the umbrella canopy 520 to be connected to the skeletal frame structure of the retractable umbrella frame device 500 while the device 100 is in a retracted state and during the transition from a retracted and extended state without significantly damaging the material of the canopy 520. The arms 108 and/or the support cage 506 can pass through the canopy slits 522 as the canopy 520 folds and unfolds as the retractable umbrella frame device 500 retracts and extends.

It is understood that while the specialized umbrella canopy 520 comprising canopy slits 522 is shown and described with reference to FIG. 5A, and indeed due to the incorporation of a support cage 506 in FIG. 5A this specialized canopy 520 is particularly useful in this embodiment, the canopy 520 comprising the canopy slits 522 can be utilized with any of the embodiments of the present disclosure, for example, the embodiments of FIGS. 1A-1M, FIGS. 2A-2C and FIGS. 3A-3B. In these embodiments, the arms 108 can be aligned with the canopy slits 522 to prevent or mitigate damage to the umbrella canopy 520 when the canopy is connected to the device as it retracts and extends.

FIG. 5B further shows a variant strut 524 which is vertical and/or edged in between the portions connecting the secondary support structure 504 (hidden in this view by the canopy 520) to the internal axis structure 104. This allows for better alignment between the canopy slits 522 and the struts 524. Also shown in FIG. 5B is that the arms 108 and/or the guide structures 520 can be aligned with the slits 522 to help facilitate transition of the device 500 between retracted and extended states.

The canopy slits 522 can provide many different advantages. For example, the canopy slits 522 can provide protection from strong winds by allowing some air through the umbrella canopy 520. The canopy slits 522 can allow for directed folding of the umbrella canopy 520, so that in embodiments wherein the umbrella canopy 520 is connected to the device 500 throughout the extension and retraction process, the canopy 520 is less likely to tear or rip. One advantage of embodiments utilizing several smaller canopy slits 522 rather than fewer larger ones is that less light and/or rain can breach the umbrella canopy 520 through the slits 522 when it is fully deployed.

In some embodiments, the canopy slits 522 can comprise various features to allow for the slits to be readily opened or closed, for example, adjustable connection features such as hook and loop connections (like Velcro®), magnets, buttons or snap connection features. This can allow the width of the opening of the slits to be better controlled, for example, allowing the struts 508, 524 and arms 108 to breach the slits 522, but then for the slits to be configured to close when desired, for example, when deployed and under heavy rain.

In some embodiments, one or more portions of the retractable umbrella frame structures incorporating features of the present invention can comprise lighting features, for example incandescent light emitters or solid state light emitters such as light-emitting diodes (LEDs). In some preferred embodiments incorporating lighting features, one or more portions of the base body structure and/or the secondary support structures can comprises light emitters. This provides an advantage of allowing the retracted device still function as a lighting device.

Figure 6A:
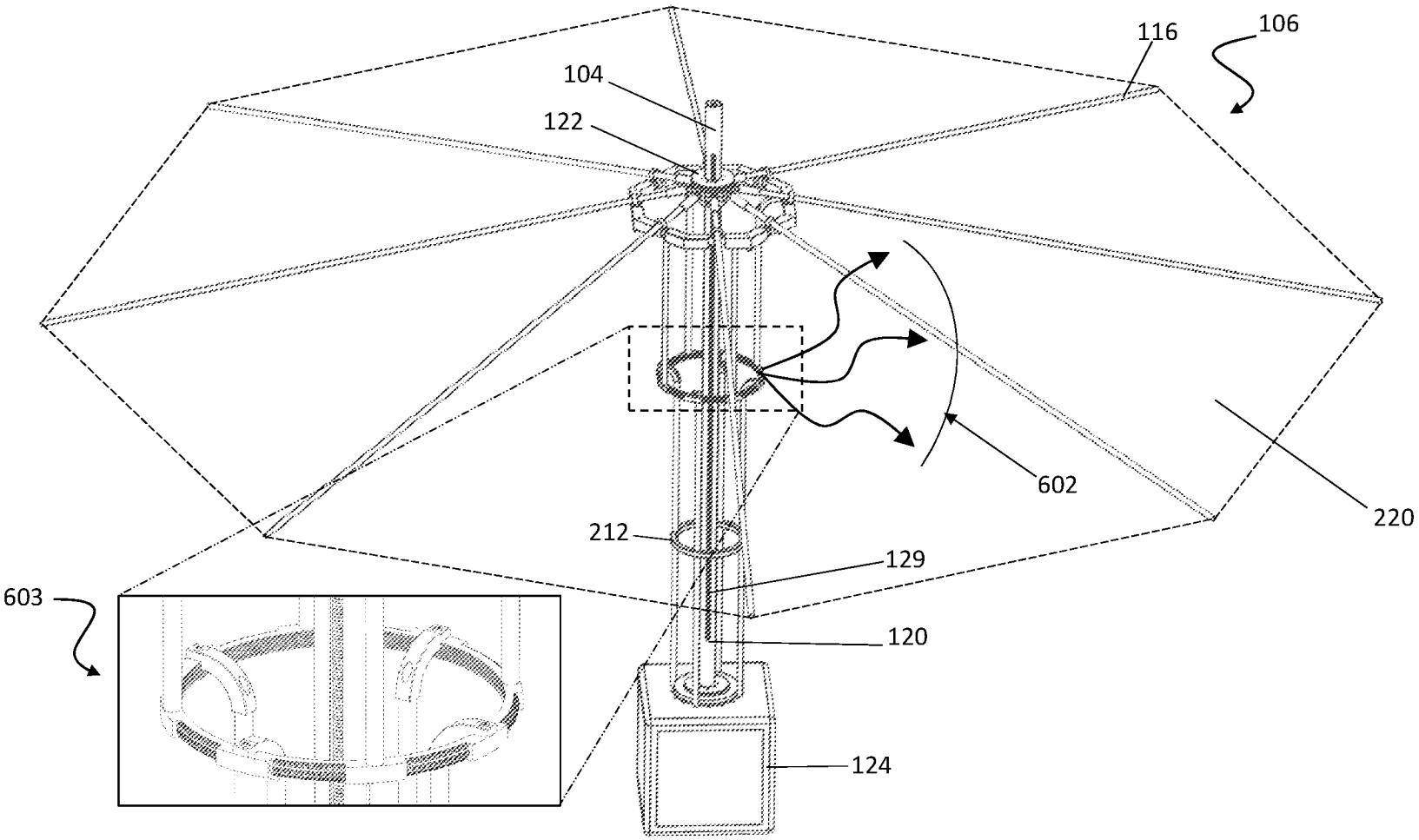
FIG. 6A is a front perspective view of the embodiment of the retractable umbrella frame device of FIG. 1F, shown with lighting feature incorporated.

FIG. 6A shows an example embodiment of a retractable umbrella frame structure 600, similar to the retractable umbrella frame device 100 in FIG. 1F, wherein like reference numbers are utilized to denote like features, shown comprising including: the base body structure 102 (spanning a length from the first end 110 to the second end 112), the internal axis structure 104, the skeletal umbrella frame structure 106, the arms 108 (comprising connected ends 114 and free ends 116), the hub structure 118, the first stop structure 120, the second stop structure 122, the mounting base 124, the moveable component 129, solid base body support walls 200, open portions 202 of the base body structure 102, a tapering point 204, secondary support structures 206 (including a first ring 208, a second ring 210 and a third ring 212), and an umbrella canopy 220.

Figure 6B:
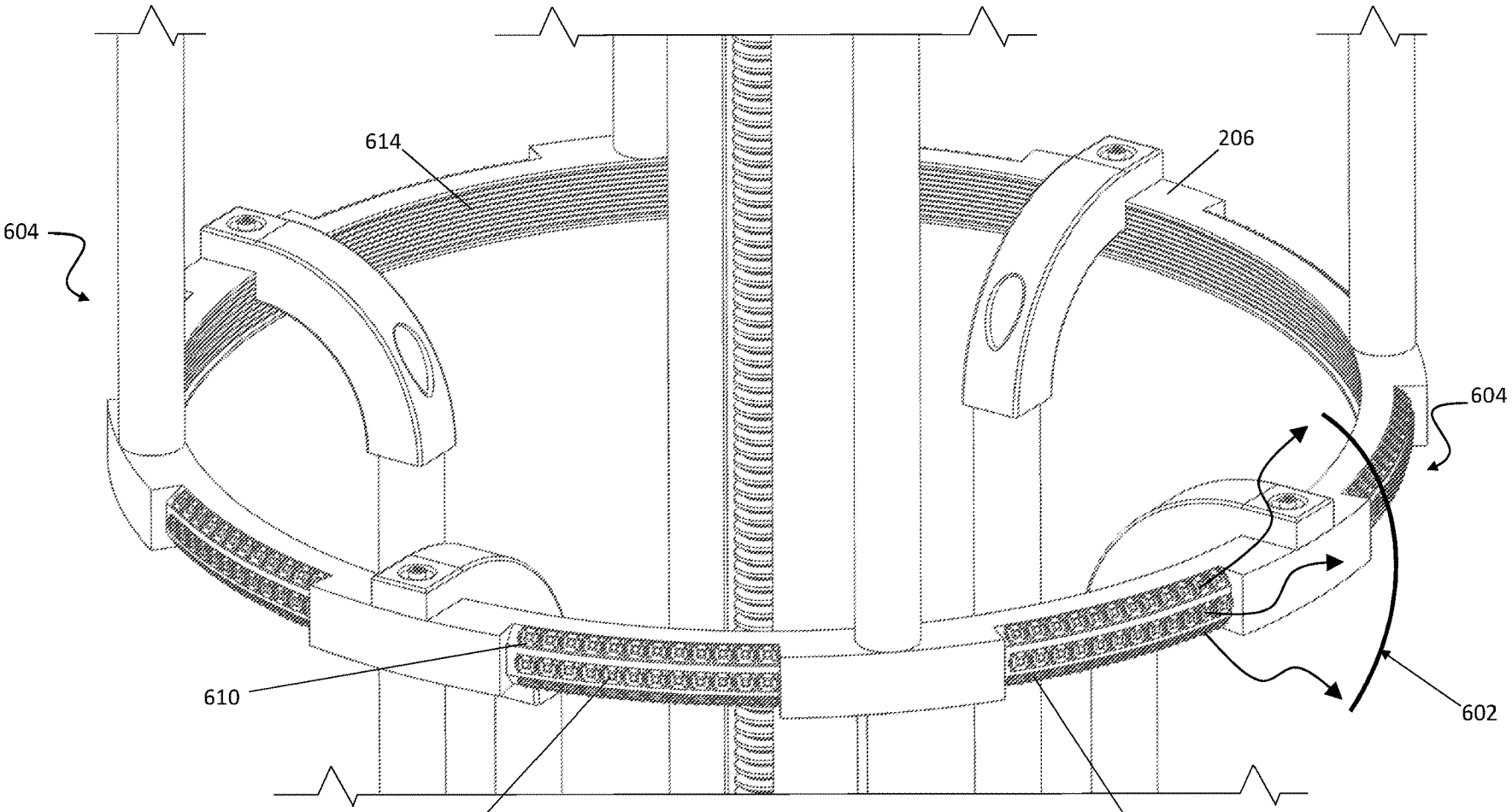
FIG. 6B is a partial zoomed-in front perspective view of a portion of the embodiment of the retractable umbrella frame device of FIG. 6A.

The retractable umbrella frame structure 600 additionally comprises lighting features that can allow for lighting output 602 in one or more directions, for example, upward toward the umbrella canopy 220 downward toward the surface on which the device 600 rests or horizontally outward. FIG. 6B shows a zoomed-in view 603 of an example lighting feature position as applied to a support structure 206 that can achieve the directional light emission 602. FIG. 6B shows the secondary support structure 206 comprising one or more light emitters 604 in various example positions. One or more outward horizontal light emitters 606 can be included on the outside horizontal surface of the secondary support structure 206 in order to direct light outward in a horizontal direction. In some embodiments, one or more inward horizontal light emitters can be included on the inside horizontal surface of the secondary support structure 206 in order to direct light inward in a horizontal direction, to illuminate the internal portions of the base body structure 102.

Likewise, one or more upward vertical light emitters 610 can be included on the upper surface of the secondary support structure 206 in order to direct light upward in a vertical direction, for example, to illuminate the space under the umbrella canopy 220. Furthermore, one or more downward vertical light emitters 612 can be included on the lower surface of the secondary support structure 206 in order to direct light downward in a vertical direction, for example, to illuminate the space upon which the mounting base 124 sits.

In some embodiments, one or more of the optional light emitters 604 can be connected to the secondary support structure 206 and/or a portion of the base body structure 102 via a moveable connection, including any moveable connection discussed herein. In some embodiments, the light emitter 604 can be moveably connected via a moveable mount structure, which is an intermediate structure that can be configured to allow a connected light emitter 604 to pivot about the moveable mount connection to allow a single light emitter to provide light to a plurality of directions. In some embodiments, a portion of the secondary support structure 206, for example, an inner surface of the secondary support structure 206 can comprise circuitry 614, which can place the emitters 604 in electrical communication with electronic or power features, for example, electronic control features or power features as described herein in with regard to the embodiments of FIGS. 1A-1M above. In some embodiments, the circuitry 614 can include logic circuits configured to control the light emitters 604.

In embodiments incorporating lighting features, the light emitters can be controlled automatically, for example via electronic control features described herein and/or can be manually activated, for example, utilizing switches or remote-control devices.

Although the present invention has been described in detail with reference to certain preferred configurations thereof, other versions are possible. Embodiments of the present invention can comprise any combination of compatible features shown in the various figures, and these embodiments should not be limited to those expressly illustrated and discussed. Therefore, the spirit and scope of the invention should not be limited to the versions described above.

The foregoing is intended to cover all modifications and alternative constructions falling within the spirit and scope of the invention as expressed in the appended claims, wherein no portion of the disclosure is intended, expressly or implicitly, to be dedicated to the public domain if not set forth in any claims.

I claim:

1. A retractable umbrella frame device, comprising:

a base body structure, said base body structure comprising a first end, a second end, and a length between said first end and said second end;

a central axis structure, said central axis structure at least partially surrounded by said base body structure and substantially spanning said length of said base body structure from said first end to said second end;

a plurality of secondary support structures connected to said base body structure between said first end and said second end, wherein at least one of said secondary support structures in said plurality of secondary support structures comprises one or more light emitters;

a skeletal frame structure, said skeletal frame structure comprising a plurality of arms, each arm in said plurality of arms comprising a connected end and a free end, said connected ends moveably connected to said central axis structure such that travel of said connected ends from said second end to said first end retracts said plurality of arms into said base body structure and travel of said connected ends from said first end to said second end extends said plurality of arms from said base body structure; and one or more guide structures connected to at least one of said arms in said plurality of arms and at least one of said secondary support structures in said plurality of secondary support structures.

2. The retractable umbrella frame device of claim 1, wherein said central axis structure further comprises a movement component at least partially internal to said central axis structure, wherein at least one arm in said plurality of arms is connected to said movement component.

3. The retractable umbrella frame device of claim 1, further comprising an umbrella canopy connected to said skeletal umbrella structure.

4. The retractable umbrella frame device of claim 1, wherein said one or more light emitters comprise horizontal light emitters.

5. The retractable umbrella frame device of claim 1, wherein said one or more light emitters comprise vertical light emitters.

6. The retractable umbrella frame device of claim 1, wherein said one or more light emitters comprise both horizontal and vertical light emitters.

7. The retractable umbrella frame device of claim 1, wherein said one or more light emitters comprise light-emitting diodes (LEDs).

8. The retractable umbrella frame device of claim 1, further comprising an actuator configured to retract said plurality of arms of said skeletal frame structure into said base body structure.

9. The retractable umbrella frame device of claim 1, wherein said base body structure tapers in diameter from said second end to said first end.

10. A retractable umbrella frame device, comprising:

a base body structure, said base body structure comprising a first end, a second end, and a central axis structure, said central axis structure substantially spanning the length between said first end and said second end;

a plurality of secondary support structures connected to said base body structure between said first end and said second end;

a skeletal umbrella structure, said skeletal umbrella structure comprising a plurality of arms, each arm in said plurality of arms comprising a connected end and a free end, said connected ends moveably connected to said central axis structure such that travel of said connected ends from said second end to said first end retracts said plurality of arms into said base body structure and travel of said connected ends from said first end to said second end extends said plurality of arms from said base body structure; and an umbrella canopy connected to said skeletal umbrella structure, said umbrella canopy comprising one or more canopy slits;

wherein said each secondary support structure in said plurality of secondary support structures tapers in diameter from said second end of said base body structure to said first end of said base body structure.

11. The retractable umbrella frame device of claim 10, further comprising a support cage connected to at least one of said secondary support structures in said plurality of secondary support structures.

12. The retractable umbrella frame device of claim 10, wherein at least one of said secondary support structures in said plurality of secondary support structures comprises one or more light emitters.

13. The retractable umbrella frame device of claim 12, wherein said one or more light emitters comprise light-emitting diodes (LEDs).

14. The retractable umbrella frame device of claim 10, wherein each secondary support structure in said plurality of secondary support structures comprises a ring structure.

15. The retractable umbrella frame device of claim 10, wherein at least one secondary support structure in said plurality of secondary support structures comprises one or more guide structures connected to at least one of said arms in said plurality of arms and at least one of said secondary support structures in said plurality of secondary support structures.

* * * * *